US007040701B2

(12) United States Patent
Tada

(10) Patent No.: US 7,040,701 B2
(45) Date of Patent: May 9, 2006

(54) RECLINING DEVICE

(76) Inventor: Hirofumi Tada, 201, Mezon Tsuzuki, 24-19, Izumi 2-chome,Higashi-ku, Nagoya-shi, Aichi 461-00 (JP)

( * ) Notice: Subject to any disclaimer, the term of this patent is extended or adjusted under 35 U.S.C. 154(b) by 0 days.

(21) Appl. No.: 10/470,183

(22) PCT Filed: Jan. 24, 2002

(86) PCT No.: PCT/JP02/00537

§ 371 (c)(1),
(2), (4) Date: Oct. 1, 2003

(87) PCT Pub. No.: WO02/065876

PCT Pub. Date: Aug. 29, 2002

(65) Prior Publication Data

US 2004/0155504 A1 Aug. 12, 2004

(30) Foreign Application Priority Data

| | | |
|---|---|---|
| Jan. 25, 2001 | (JP) | 2001-016514 |
| Jun. 12, 2001 | (JP) | 2001-176786 |
| Oct. 22, 2001 | (JP) | 2001-323828 |
| Jan. 22, 2002 | (JP) | 2002-012843 |

(51) Int. Cl.
*A47C 1/02* (2006.01)

(52) U.S. Cl. ..... 297/318; 297/343; 297/256.13

(58) Field of Classification Search ..... 297/318, 297/341, 342, 256.13, 343
See application file for complete search history.

(56) References Cited

U.S. PATENT DOCUMENTS

| | | | | |
|---|---|---|---|---|
| 338,895 | A * | 3/1886 | Weeden | 297/342 |
| 1,822,427 | A * | 9/1931 | Wen et al. | 297/342 |
| 3,567,280 | A * | 3/1971 | Bradshaw | 297/318 |
| 4,452,486 | A * | 6/1984 | Zapf et al. | 297/343 |
| 4,504,090 | A * | 3/1985 | Goldman | 297/342 |

FOREIGN PATENT DOCUMENTS

| | | | |
|---|---|---|---|
| JP | 47-017567 | * | 9/1972 |
| JP | 47-17567 | A | 9/1972 |
| JP | 4-90719 | | 3/1992 |
| JP | 05-023080 | | 2/1993 |
| JP | 8-126547 | A | 5/1996 |

* cited by examiner

*Primary Examiner*—Milton Nelson, Jr.
(74) *Attorney, Agent, or Firm*—Davis & Bujold, P.L.L.C.

(57) ABSTRACT

A reclining apparatus which includes guide members (20) that move forward and backward on opposite sides of a bottom plate (3). The guide members (20) are moved forward and backward by a roller (21, 22) that is slidable and rotatable along a surface of the bottom plate (3). A seat member (30) and a back member (50) are attached to the guide members (20) and, accordingly, are able to move smoothly forward and backward without excessive force.

6 Claims, 23 Drawing Sheets

LOCKED STATE

UNLOCKED STATE

LOCKED STATE

UNLOCKED STATE

UNLOCKED STATE

LOCKED STATE

RECLINING DEVICE

TECHNICAL FIELD

The present invention relates to a reclining apparatus in which smooth forward/backward movement is possible and further locking is possible at an arbitrary posture in chairs or beds including a legless chair.

BACKGROUND ART

There has heretofore been a reclining apparatus disclosed in Japanese Patent Application Laid-Open No. 4-90719 which is an application of the present applicant, and a mechanism is disclosed in this publication in which a back member is locked and unlocked via an armrest member in order to adjust the back member of a chair at an arbitrary angle.

However, it is troublesome for a person who sits on a seat member to operate the armrest member in order to adjust the back member at the arbitrary angle.

Moreover, a structure in which the back member is moved with inclination of the back member is desirable in order to obtain a comfortable state in the chair, and the like.

Consequently, the inventor has intensively repeated researches, has found a mechanism in which the seat member has a straight movement property to achieve a smooth forward/backward movement and in which the back member can be adjusted at an appropriate angle in accordance with the position of the seat member without any operation of the armrest member and in which a lock state and unlock stage can be obtained at the angle of the back member, and has provided the mechanism herein.

DISCLOSURE OF THE INVENTION

In a reclining apparatus of the present invention, guide members 20 movable forwards/backwards are disposed on the opposite sides of a bottom plate 3, and a back member 50 for supporting a person's back is rotatably connected to the guide members 20.

Moreover, in a constitution in which a forward/backward movable seat member 30 is attached to the guide members 20 movable forwards/backwards by a roller slidable/rotatable over the whole surface of the bottom plate 3, smooth forward/backward movement is possible without prying the guide members 20.

It is to be noted that this roller is at least any one of a front roller 21 and back roller 22 shown in FIG. 3 and auxiliary rollers 80, 135 shown in FIGS. 7, 15.

Therefore, the seat member 30 and the back member move forwards/backwards together accompanying the forward/backward movement of the guide members 20, and the back member 50 can be set to a predetermined inclination angle in accordance with the position of the seat member 30 (guide members 20).

Moreover, in the reclining apparatus of the present invention, the forward/backward movable guide members 20 are disposed on the opposite sides of the bottom plate 3, the back member 50 for supporting the person's back is rotatably connected to the guide members 20 via an axial member 55, and further the back member 50 is reclinably supported with respect to foot members 12.

For a reclining support mechanism in the back member 50, for example, a transverse support member 58 fixed to the foot members 12 is supported via a cam hole 56 formed in a back support part 51 (FIG. 2), or conversely the transverse support member 58 is fixed to the back support part 51 and the opposite ends of the transverse support member 58 are inclined/supported via guide grooves 58A formed in the foot members 12 (FIG. 20).

Furthermore, the seat member 30 is attached to the guide members 20, 120 which move forwards/backwards by the roller capable of sliding/rotating on the bottom plate 3.

Additionally, lock means is constituted of a brake shoe 28 and back roller 22, for example, in the reclining apparatus shown in FIG. 4(A) or 12(A), and is constituted of an upper brake shoe 128*a* and lower brake shoe 128*b* in the reclining apparatus shown in FIG. 15.

Therefore, when a load is applied to the seat member 30 and back member 50 (back plate 59), the guide members 20 rock, the bottom plate 3 is held by the lock means and accordingly brought into a locked state, the bottom plate 3 is not held and brought into an unlocked state, and the back member 50 can easily be chanced to an inclined state at an arbitrary angle in a simple structure.

Moreover, in the reclining apparatus of the present invention, the forward/backward movable guide members 20 are disposed on the opposite sides of the bottom plate 3, the back member 50 for supporting the person's back is rotatably connected to the guide members 20 via the axial member 55, and further the back member 50 is reclinably supported with respect to the foot members 12.

For the reclining support mechanism of the back member 50, for example, the transverse support member 58 fixed to the foot members 12 is supported via the cam hole 56 formed in the back support part 51 (FIG. 2), or conversely the transverse support member 58 is fixed to the back support part 51 to support the opposite ends of the transverse support member 58 via the guide grooves 58A formed in the foot members 12 (FIG. 20).

Moreover, to the guide members 20 which move forwards/backwards via the front and back rollers capable of sliding/rotating on the bottom plate, for example, as shown in FIGS. 4(A) and 12(A), the brake shoe 28 which can contact the bottom plate 3 and seat member 30 are attached.

Furthermore, as shown in FIG. 4(A) or 12(A), when a load G1 is applied to the seat member 30, the guide members 20 descent and rotate in a counterclockwise direction, and therefore the brake shoe 28 and back roller 22 hold the bottom plate 3 to obtain the locked state (FIG. 13(A)).

On the other hand, as shown in FIGS. 4(B), 6, 12(B)(C), when a load G2 or G3, G3' is applied, the guide members 20 are moved backwards, and the holding of the bottom plate 3 by the brake shoe 28 and back roller 22 is released to obtain the unlocked state (FIGS. 4(B), 6, 13(B)(C)).

Therefore, in the unlocked state, the back member 50 and seat member 30 move forwards/backwards together. Thereafter, when the load G1 is applied to obtain the locked state, the posture can be maintained, and the inclination angle of the back member 50 can easily be changed in the simple structure.

Moreover, in the reclining apparatus of the present invention, the auxiliary roller 80 is attached to the guide members 20 behind the axial member 55 so that the roller can roll on the bottom plate 3, when the guide members 20 rotate in a clockwise direction.

Therefore, as shown in FIG. 8(B), when the load G3 is applied, the guide members 20 rotate In the clockwise direction and are brought in the unlocked state, and the auxiliary roller 80 rolls on the bottom plate 3 and moves the guide members 20 in a front direction to bring the back member 50 into an inclined posture. Moreover, as shown in FIG. 10, when a load G4 is applied to a connection plate 39, the guide members 20 rotate in the clockwise direction to obtain the unlocked state, and the auxiliary roller 80 rolls on the bottom plate 3 to move the guide members 20 in a backward direction. Furthermore, subsequently, as shown in FIG. 6, when the load G2 is applied, the inclined posture of the back member 50 shifts to a vertical posture. Moreover, when a person lifts up hip a little to push the tip end of the seat member 30 in the backward direction with a leg, the unlocked state is obtained, and the inclined posture of the back member 50 can easily be sifted to the vertical posture.

Moreover, in the reclining apparatus of the present invention, a roller plate is formed in a convex curve shape, and therefore the inclined posture of the back member 50 can be shifted to the vertical posture only by the load G4.

Furthermore, for the reclining apparatus of the present invention, the bottom plate 3 is formed in a front-rising inclined shape, and accordingly the backward movement of the guide members 20 is facilitated.

Moreover, for the reclining apparatus of the present invention, an armrest part is constituted to be movable forwards/backwards with respect to the foot members, and a side plate (or the seat member) is movable forwards/backwards via a connection member attached to the armrest part. Therefore, by the forward/backward movement of the armrest part, the back member can easily be changed to a vertical state from a comfortable state, or to the comfortable state from the vertical state.

Furthermore, in the reclining apparatus of the present invention, the forward/backward movable guide members 120 are disposed on the opposite sides of the bottom plate 3, the back member 50 for supporting the person's back is rotatably connected to the guide members 120 via the axial member 55, and further the back member 50 is reclinably supported with respect to the foot members 12.

For the reclining support mechanism of the back member 50, for example, the transverse support member 58 fixed to the foot members 12 is supported via the cam hole 56 formed in the back support part 51 (FIG. 2), or conversely the transverse support member 58 is fixed to the back support part 51 to recline/support the opposite ends of the transverse support member 58 via the guide grooves 58A formed in the foot members 12 (FIG. 20).

Moreover, at least one of the upper brake shoe 128*a* which can contact the surface of the bottom plate 3 by a front press member 121 attached to the guide members 120, and the lower brake shoe 128*b* which can contact the back surface of the bottom plate 3 by a back press member 122 attached to the guide members 120 is attached.

Moreover, the slidable/rotatable auxiliary roller 135 is attached to the guide members 120 behind the axial member 55 on the front-surface side of the bottom plate 3. When loads Ga, Gb shown in FIGS. 16(A), 19(A), 22(A) are applied, the brake shoe (128*a*, 128*b*) is brought into the unlocked state in which the bottom plate 3 is not held via the guide members 120. While the back member 50 is inclined (comfortable state) via the load Gb for pressing the back member 50, the guide members 120 are moved. In this state, when loads Gc, Gd shown in FIGS. 16(B), 19(B), 22(B) are applied, the guide members 120 rock, the bottom plate 3 is accordingly held and brought into the locked state by the brake shoe (128*a*, 128*b*), and the inclination angle of the back member can easily be changed in the simple structure.

BEST MODE FOR CARRYING OUT THE INVENTION

The present invention will be described in more detail.

FIRST EMBODIMENT

Figure 1C:
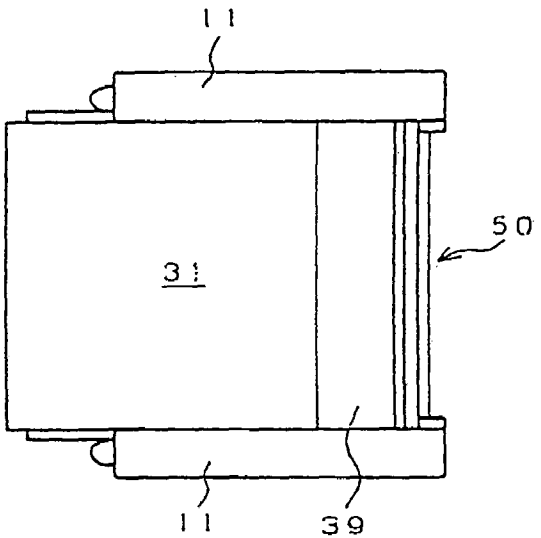
FIG. 1(A) is a front view of a chair in a first embodiment, (B) is a rear view, and (C) is a plan view.
Figure 1B:
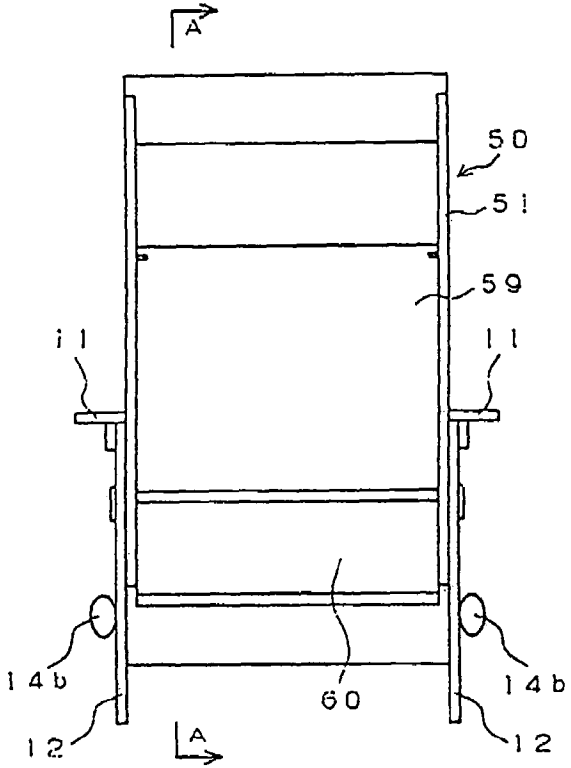
Figure 1A:
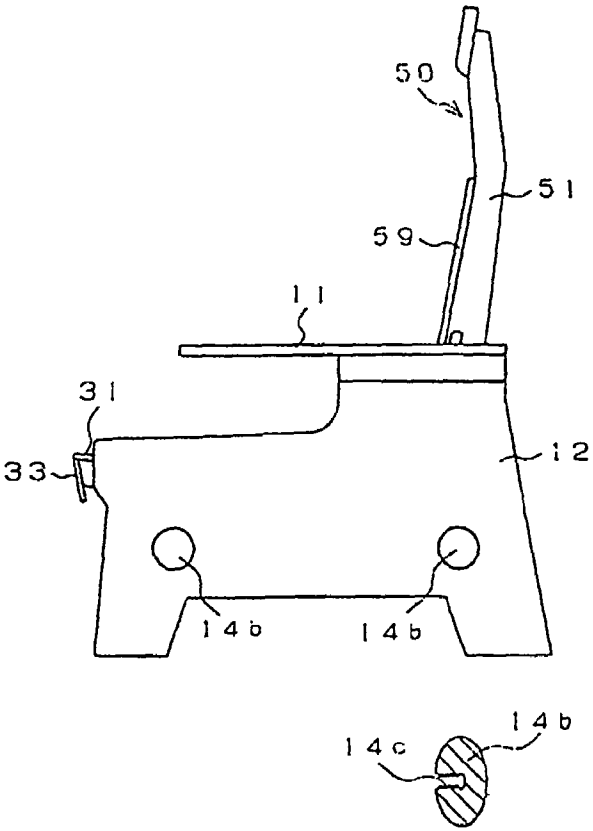
Figure 2:
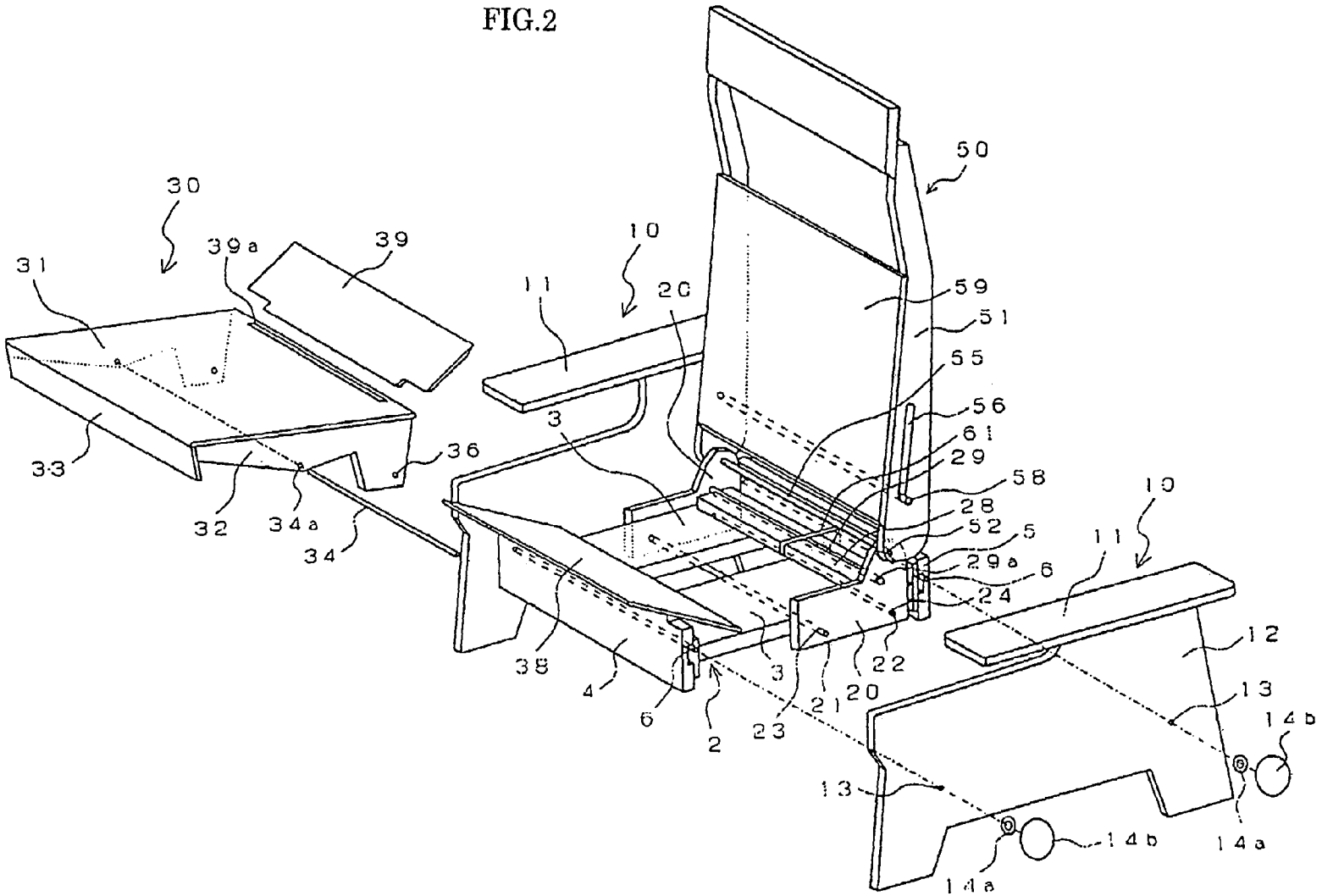
FIG. 2 is a constituting component diagram of the chair in the first embodiment.
Figure 3:
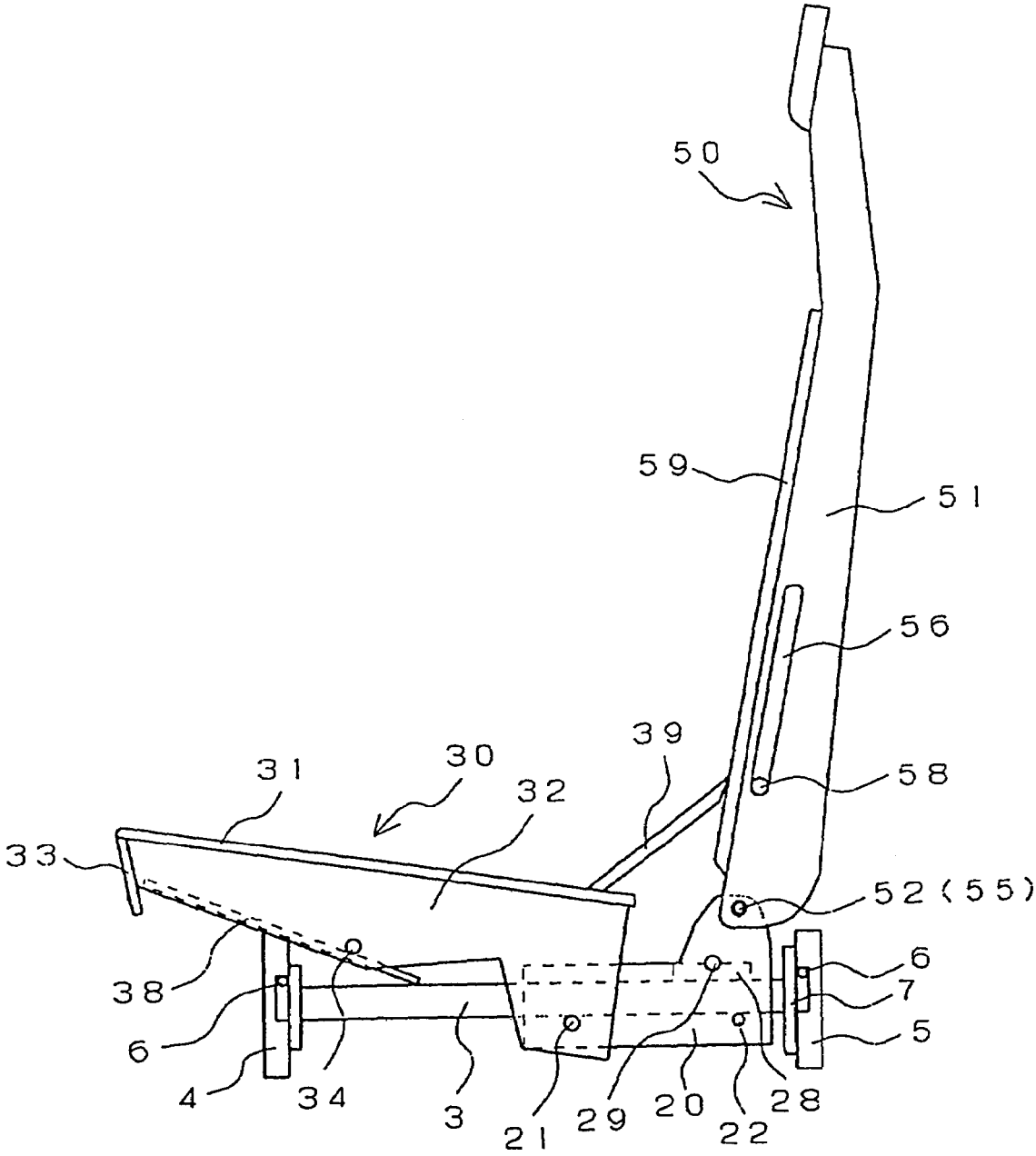
FIG. 3 is a diagram of a vertical posture (view of arrows A—A) in the first embodiment.
Figure 4A:
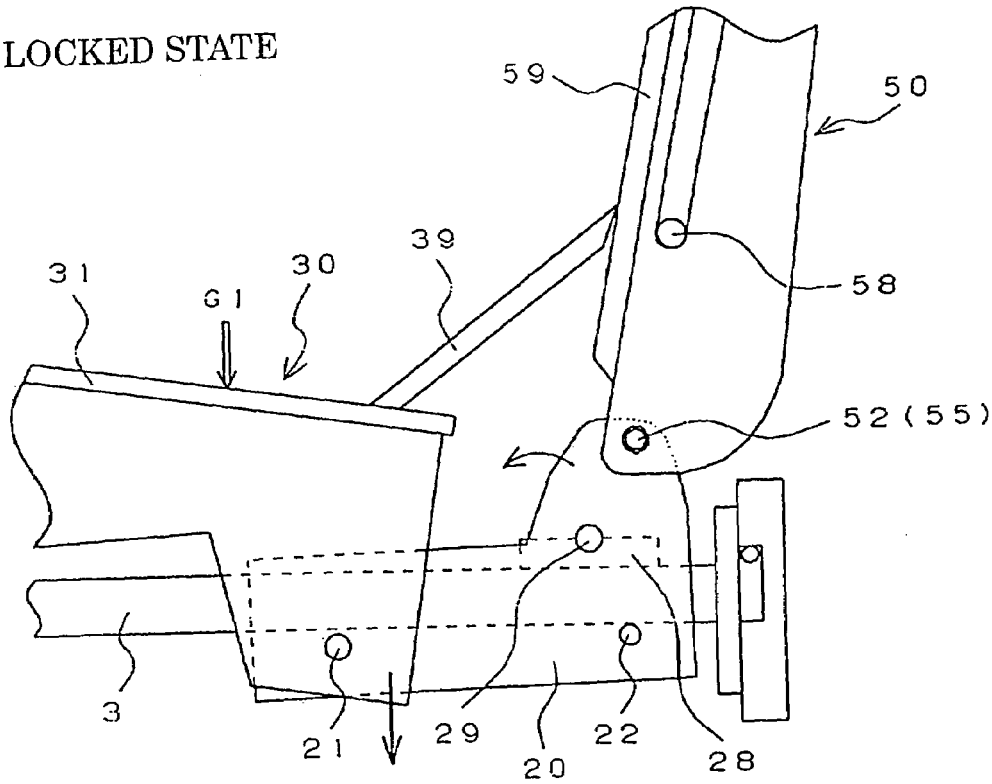
FIGS. 4(A)(B) are explanatory views of the function of the chair in the first embodiment.
Figure 4B:
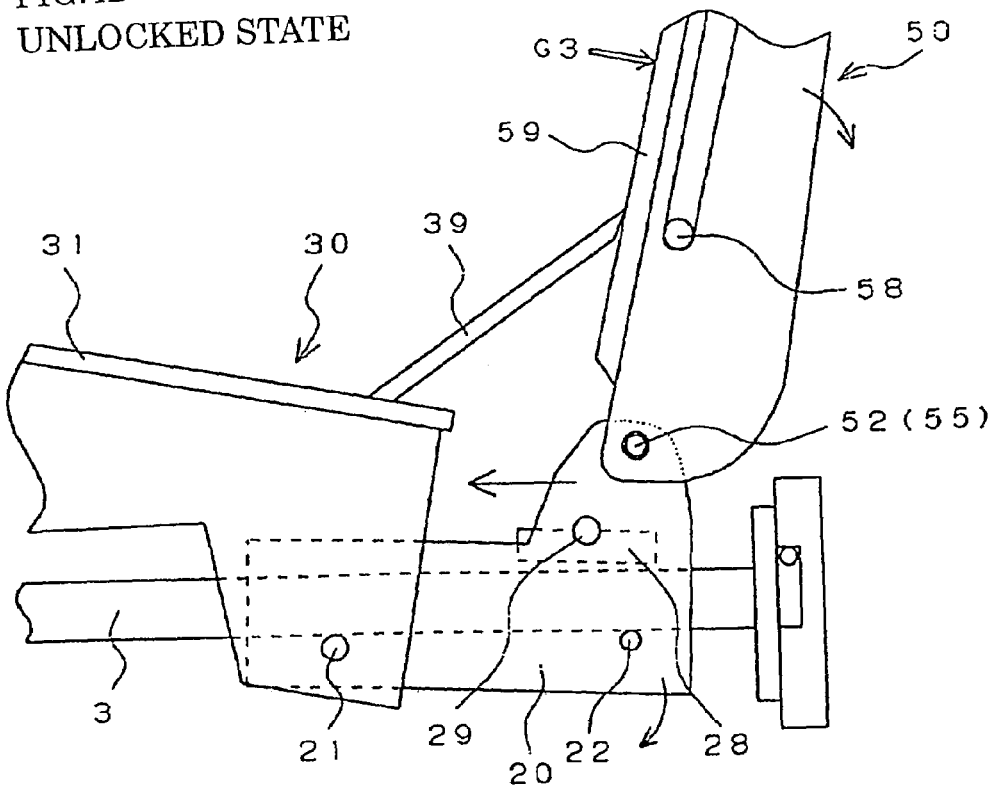
Figure 5:
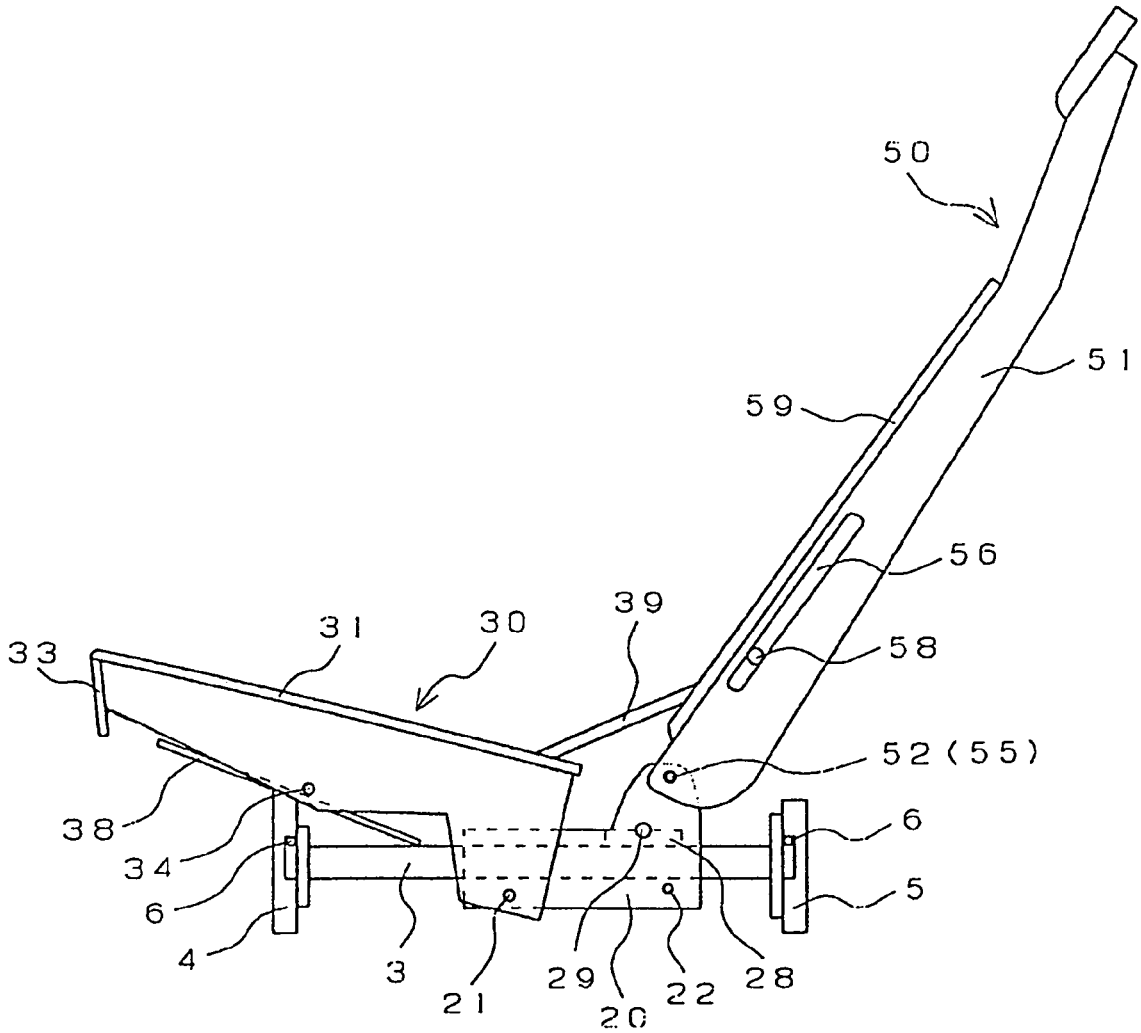
FIG. 5 is a diagram showing a back member in an inclined posture in the first embodiment.

An embodiment in which a reclining apparatus is applied to a chair will be described with reference to FIG. 1(A) showing the front surface of the chair, FIG. 1(B) showing a rear surface, FIG. 1(C) showing a plane, FIG. 2 showing constituting components, FIG. 3 showing an A—A arrow view, FIGS. 4 and 6 which are partially enlarged views showing a function, and FIG. 5 showing the A—A arrow view in which a back member has an inclined posture.

The chair is mainly constituted of a base 2, a pair of armrest members 10 disposed on left/right sides, a seat member 30 for supporting person's hip, a back member 50 which contacts a person's back, a pair of guide members 20 for moving the seat member 30 forwards/backwards, and the like so that the chair can easily be assembled without using tools such as a spanner.

The base 2 is constituted of two bottom plates 3 (may be constituted of one plate), front plate 4 and back plate 5. The front plate 4 and the back plate 5 are formed to be bonded in the front/back of the bottom plates 3 disposed horizontally, and a through-bolt 6 to be fixed including screws formed in opposite ends is attached to respective bonded portion in the front plate 4 and back plate 5 so that the armrest members 10 are fixed via knob nuts 14*b*. It is to be noted that a rubber plate 7 for buffer prevention is attached to the front of the back plate 5.

The armrest members 10 include armrest parts 11 constituted of flat plates, and foot members 12 disposed vertical to the armrest members 10. Moreover, in the foot members 12, through-holes 13 are made in positions to be disposed opposite to the through-bolts 6, and the armrest members are fixed and assembled with knob nuts 14*b* in which washers 14*a* and nuts 14*c* are buried via the through-bolts 6.

It is to be noted that the sectional view of this knob nut 14*b* is shown in FIG. 1(A). The reclining apparatus is constituted such that the apparatus can be assembled with the knob nuts 14*b*, and therefore the apparatus can simply be assembled without using any tool (spanner, and the like).

On the opposite left and right sides of the bottom plate 3, one pair of guide members 20, which may have arbitrary shapes but have L-shapes here, are attached so as to be movable forwards/backwards.

In one pair of guide members 20, one pair of bearings 23 and one pair of bearings 24 are attached to the front and back at appropriate intervals, and a front roller 21 and back roller 22 having round rod shapes are inserted into the pairs of bearings 23 and 24, respectively, so as to be slidable/rotatable on the whole back surface of the bottom plate 3.

Therefore, the guide members 20 have rectilinear properties (forward/backward movement) by the front roller 21 and back roller 22 which are slidable/rotatable on the whole surface of the bottom plate 3, and smooth rotation (movement) is possible via the constitutions of the opposite ends via the bearings 23, 24.

In this manner, the structure in which the front roller 21 (or the back roller 22) is disposed so as to be slidable/rotatable on the bottom plate 3 and the guide members 20 are moved forwards/backwards is significant for the structure of the chair, because the rectilinear properties of the seat member 30 is secured without prying one pair of guide members 20. Especially, as described later, for the structure of the chair in which the seat member 30 and back member 50 are integrally moved forwards/backwards, smooth movement is possible.

Moreover, the diameters of the front roller 21 and back roller 22 are appropriately selected in consideration of rotary momentum and resistance, and either one of the front roller 21 and back roller 22 does not have to be necessarily formed so as to be slidable on the whole surface of the bottom plate 3, and may be constituted to be slidable in the part of the bottom plate 3. That is, since either one of the front roller 21 and back roller 22 is formed so as to be slidable on the whole surface of the bottom plate 3, the guide members 20 can have the rectilinear properties (forward/backward movement).

Moreover, a brake shoe 28 which has a flat plate shape and which can contact the surface of the bottom plate 3 is attached via a lock rod 29 inserted in an attachment hole 29*a* formed in the pair of guide members 20, so that the she can contact the surface of the bottom plate 3. It is to be noted that the lock rod 29 is positioned in the vicinity of the front roller 21 rather than the back roller 22.

Subsequently, for the brake shoe 28, when the guide members 20 slightly rock, that is, rotate in a counterclockwise direction, the shoe holds the bottom plate 3 together with the back roller 22 to obtain the locked state. When the members rotate in the clockwise direction, the shoe is detached and brought into the unlocked state. It is to be noted that the brake shoe 28 and back roller 22 constitute lock means capable of holding or releasing the bottom plate 3.

Moreover, the brake shoe 28 is constituted of a flat plate having a large contact area with the bottom plate 3, has a large resistance by the contact, and can sufficiently maintain the locked state.

It is to be noted that the attachment position (gap) of the brake shoe 28, front roller 21, and back roller 22 with respect to the bottom plate 3 is a position where the locked or unlocked state is possible by the slight rocking of the guide members 20 described later.

A roller plate 38 having a flat plate shape is attached to the top of the front plate 4 over from the bottom plate 3 in a front-rising inclined state as shown in FIG. 2, and this inclination angle is the angle at which the fit state of the person's hip and back can be maintained with the back member 50 in a seated state.

Moreover, the seat member 30 is constituted of a hip plate 31, side plates 32 fixed on the opposite sides of the hip plate, and a front plate 33, and has a box shape including an open bottom part so that the roller plate 38 is covered.

Furthermore, a seat member roller 34 rotatable on the roller plate 38 is inserted into one pair of bearings 34*a* attached to one pair of side plates 32, and can smoothly rotate.

Additionally, insertion holes 36 are made in the side plates 32 in the rear end of the seat member 30 so as to meet the position of the front roller 21, and this seat member 30 is attached via the front roller 21 outside the guide members 20. It is to be noted that the insertion holes 36 are positioned so that the guide members 20 can descend (rotate in the counterclockwise direction) via the front roller 21, when the load G1 is applied on the rear side of the seat member 30.

Therefore, the seat member 30 maintains the inclined posture and can move forwards/backwards via the seat member roller 34 which rolls on the roller plate 38. Moreover, accompanying the forward/backward movement of this seat member 30, the guide members 20 also move forwards/backwards. When the load G1 is applied on the rear side of the seat member 30, the locked state is obtained.

It is to be noted that the mechanism for moving the seat member 30 forwards/backwards may be a structure in which the roller plate 38 is attached to the back surface of the seat member 30 and the seat member roller 34 is rotatably attached to the foot members 12.

Moreover, an elongated hole 39*a* is disposed in the rear end of the surface of the seat member 30, a connection plate 39 is inserted in the elongated hole 39*a* in an inclined manner, the other end of the plate is reclined onto a back plate 59 of the back member 50 in an abutment state, and a lower gap between the seat member 30 and back plate 59 is filled. Moreover, the upper end of the connection plate 39 abuts on the back plate 59, and moves forwards/backwards together with the seat member 30.

It is to be noted that the connection plate 39 may also be extended from the hip plate 31, that is, integrally formed.

On the opposite sides of the back plate 59 of the back member 50 for supporting the person's back, one pair of back support parts 51 are formed, and one pair of axial holes 52 for a rotation shaft are made in the lower ends of one pair of back support parts 51.

Moreover, the axial member 55 is inserted in through-holes made in the guide members 20 in alignment with the axial holes 52 to connect and rotatably attach the back member 50 to the guide members 20, and the inclination angle of the back member is changed via a transverse support member 58 described later in accordance with the forward/backward movement of the guide members 20 (seat member 30).

It is to be noted that the axial member 55 is formed in such a position that when the back member 50 is pushed by the person's back, the guide members 20 use the transverse support member 58 described later as a criterion to rotate in the clockwise direction and to reach the unlocked state (substantially right above the back roller 22 in the present example).

Moreover, elongated cam holes 56 are formed toward the axial holes 52 in lower parts from the middles of the back support parts 51, the opposite ends of the transverse support member 58 inserted in the cam holes 56 are fixed to the foot members 12 of the armrest members 10, and the inclination angle of the back member 50 can be changed while supporting the back member 50.

Therefore, the reclining support mechanism of the back member 50 is realized by the transverse support member 58 along the cam holes 56. The angle of the back member 50 can be adjusted to the inclined posture from the vertical posture. Moreover, when the back member 50 is pushed by the back, the mechanism is brought into the unlocked state, and the seat member 30 is moved forwards/backwards by the axial member 55 via the rotatably attached guide members 20. That is, the back member 50 and seat member 30 move forwards/backwards together via the guide members 20.

It is to be noted that in addition to the reclining support mechanism of the back member 50, another reclining support mechanism may also be constituted. In the mechanism, the transverse support member 58 is fixed to the back support parts 51 and the cam holes 56 (guide grooves 58A in FIG. 20) are formed in the foot members 12 of the armrest members 10. When the transverse support member 58 fixed to the back member 50 rolls in the cam holes 56 (guide grooves 58A), the back member 50 can be changed between the vertical posture and inclined posture.

Moreover, an ornamental member 60 with which the inside is covered is rockably attached to the rear lower part of the back member 50.

The diameters of the front roller 21, back roller 22, seat member roller 34, and auxiliary roller 80 described later are appropriately selected so that smooth rotation is possible.

Next, the locked state and unlocked state in the chair constituted as described above, and a method of using the chair will be described with reference to FIGS. 3 to 6. It is to be noted that FIGS. 4 and 6 are partially enlarged views showing the function by the load.

Locked State (FIG. 4(A))

When the person sits down on the seat member 30, the load G1 is applied on the rear side of the seat member 30, the seat member 30 (front roller 21) slightly moves downwards by this load G1, the guide members 20 rotates in the counterclockwise direction, the back roller 22 and brake shoe 28 constituting the lock means assumes a held state with respect to the bottom plate 3, and the locked state is obtained (FIG. 4(A)).

Figure 6:
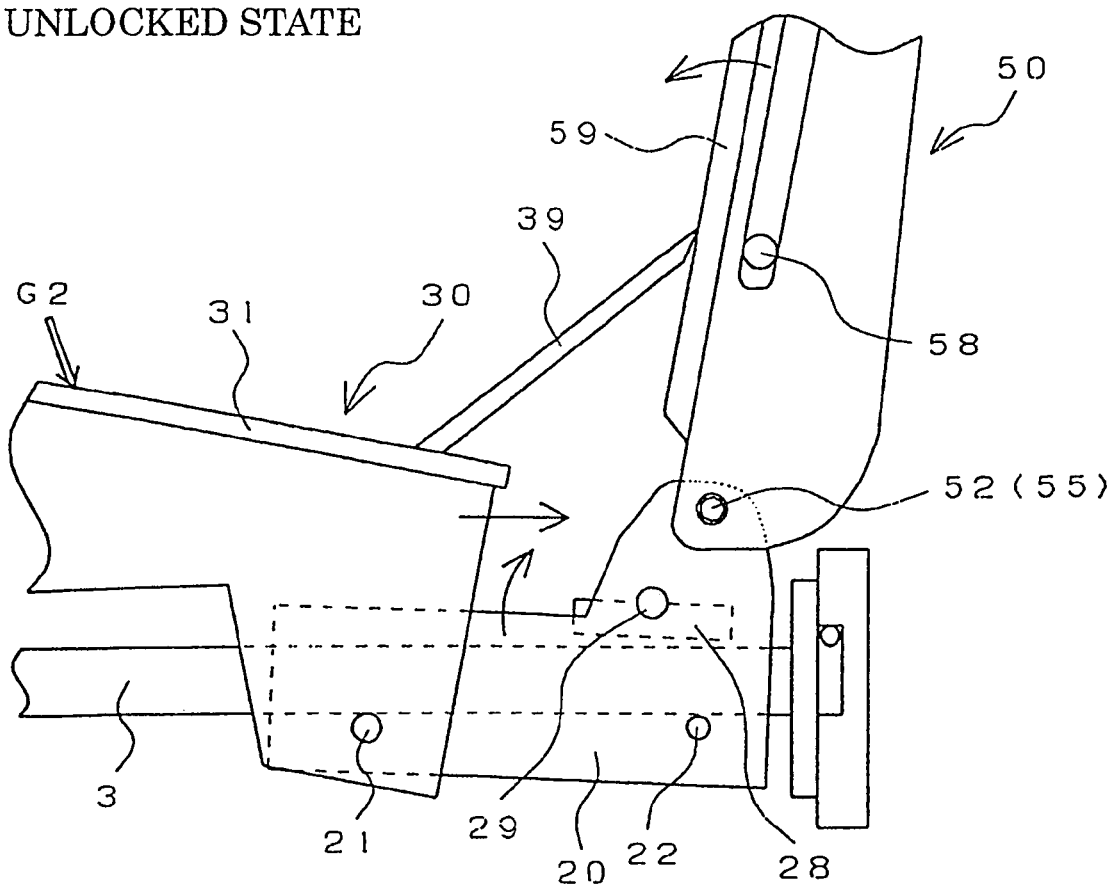
FIG. 6 is an explanatory view of the function of the chair in the first embodiment.

Unlocked State (FIGS. 4(B), 6)

In this unlocked state, the load is applied so as to avoid the locked state. That is, the load is applied so as to prevent the back roller 22 and brake shoe 28 corresponding to the lock means from being brought into the held state with respect to the bottom plate 3, and the unlocked state can be achieved.

Then, when the back member 50 is pushed by the back, the front roller 21 and back roller 22 abut on the back surface of the bottom plate 3 by the load G3, and the brake shoe 28 is brought in such a state that the surface of the bottom plate 3 is not pressed and into the unlocked state. When the guide members 20 (seat member 30) is moved in the forward direction, the back member 50 is inclined at a predetermined angle (FIG. 4(B)).

Alternatively, as shown in FIG. 6, when the load G2 is applied in an inclined manner on the front side of the seat member 30 (toward the front plate 33), the front roller 21 and back roller 22 abut on the back surface of the bottom plate 3, and the brake shoe 28 is brought in such a state that the surface of the bottom plate 3 is not pressed and into the unlocked state, and the seat member 30 is moved in the backward direction. As a result, the back member 50 can be changed to the vertical state from the inclined state.

Next, the method of using the chair will be described.

When the posture of the back member 50 is, for example, the vertical posture (FIG. 3), and when the person sits down on the seat member 30, the seat member 30 maintains the looked state by the load G1 (FIG. 4(A)).

Next, when the back member 50 is pushed by the back, the guide members 20 also rotate in the clockwise direction by the load G3 with the rotation of the back member 50 in the clockwise direction, and the front roller 21 and back roller 22 abut on the back surface of the bottom plate 3 to achieve the unlocked state. Moreover, when the back member 50 is inclined via the axial member 55, the front roller 21 and back roller 22 rotate while moving the guide members 20 in the forward direction, and the seat member 30 also moves forwards to assume the inclined posture shown in FIG. 5.

Next, after the back member 50 is inclined at the predetermined angle, the person presses down the seat member 30 with the hip, and the locked state is then obtained by the load G1 (FIGS. 5, 4(A)). Therefore, the person can sit on the chair with the posture at an arbitrary angle (in the inclined state).

It is to be noted that for this chair, the back member 50 and seat member 30 move forwards/backwards together via the guide members 20, therefore the person's backside (hip, back) maintains the fit state with respect to the seat member 30 and back member 50, and a considerable comfortable posture is obtained.

Next, to sit up from the inclined posture (comfortable posture) of the back member 50, the person applies the load G2 to the front of the seat member 30 (toward the front plate 33) on the side of the back member 50 with the leg, and sits up via the armrest parts 11. Then, the front roller 21 and back roller 22 abut on the back surface of the bottom plate 3 to obtain the unlocked state, and the back member 50 successively comes close to the vertical posture with the backward movement of the seat member 30 (FIG. 6).

Subsequently, when the back member 50 has the predetermined angle, the load G1 is applied to the seat member 30 to obtain the locked state, and the chair can return to its original posture (FIG. 4(A)).

It is to be noted that it is desirable to attach an elastic member 61 which is movement assisting means for pulling the seat member 30 (the brake shoe 28 in FIG. 2) toward the back plate 5, when the back member 50 is moved in a vertical direction. Moreover, when the elastic member 61 is attached so as to pull the seat member upwards on the side of the back plate 5, the movement of the seat member 30 is further facilitated.

Moreover, the bottom plate 3 is constituted to be horizontal. However, this bottom plate 3 is formed in a front-rising linearly inclined state such that the front plate 4 is positioned higher than the back plate 5 (see FIG. 7). Then, the movement of the guide members 20 in the backward direction is facilitated by the person's body weight in shifting the back member 50 to the vertical posture from the inclined posture.

As described above, in the structure of the reclining apparatus when a loaded portion differs, the state can change to the locked or unlocked state. Moreover, the seat member 30 and back member 50 move forwards/backwards together, the back member 50 can be inclined at an appropriate angle in accordance with the position of the seat member 30, and forward/backward movement is possible maintaining the smooth rectilinear properties by the front roller 21, back roller 22, and guide members 20, 20 which is slidable/rotatable on the whole surface of the bottom plate 3. The person's backside (hip, back) can maintain the fit state with respect to the seat member 30 and back member 50, and this is the considerable comfortable posture.

Moreover, the chair has the simple structure, and can therefore easily be assembled or disassembled. It is to be noted that the shapes of the components of the chair constituted as described above are not limited to those of the above-described embodiment.

SECOND EMBODIMENT

The present embodiment refers to a mechanism for facilitating the movement of the seat member 30, especially when the person sitting on the chair changes the inclined posture of the back member 50 (the posture of FIG. 5) to the vertical posture of the back member 50 (FIG. 3) to sit up. The mechanism will be described with reference to FIGS. 7 to 10.

It is to be noted that only the respects of the present embodiment different from those of the first embodiment will be described. The same components are denoted with the same reference numerals, and the description thereof is omitted.

The different respects are as follows.

Different from the structure in which the connection plate 39 is inserted in the inclined state in the elongated hole 39*a* disposed in the rear end of the seat member 30 and the opposite upper ends of the plate abut on the back plate 59 in the first embodiment, the ends can abut on portions 20*a* in the vicinity of the tops of the L-shaped guide members 20. That is, the guide members are constituted so as to apply the load in such a position that the rotary momentum of the clockwise direction is generated in the guide members 20, when the connection plate 39 is pushed.

In another respect, bearings (not shown) are attached to one pair of guide members 20, 20, and the auxiliary roller 80 is transversely disposed via bearings 131 attached to the foot members 12 so that the roller can roll on the surface of the bottom plate 3 and can smoothly rotate behind the axial member 55, when the guide members 20 rotate in the clockwise direction.

That is, the auxiliary roller 80 contacts the surface of the bottom plate 3, when the guide members 20 rotate in the clockwise direction, but the brake shoe 28 is attached to the position where the surface of the bottom plate 3 is not pushed (behind the axial member 55 in the present example). It is to be noted that the diameter of the auxiliary roller 80 is appropriately selected in consideration of the rotary momentum and resistance.

Moreover, the bottom plate 3 is formed in the front-rising inclined state to the front plate 4 from the back plate 5, so that the guide members 20 can smoothly move in the backward direction.

It is to be noted that it is preferable to dispose the axial holes 52 for the rotary shaft of the back member 50 in the vicinity of right above the back roller 22 so as to be slidable/rotatable on the side of the back surface of the bottom plate 3. In this case, when the back member 50 is shifted to the inclined state or the vertical state as described later, the switching to the locked state or the unlocked state is smoothly performed.

Next, the function of the reclining apparatus constituted as described above will be described.

Figure 8A:
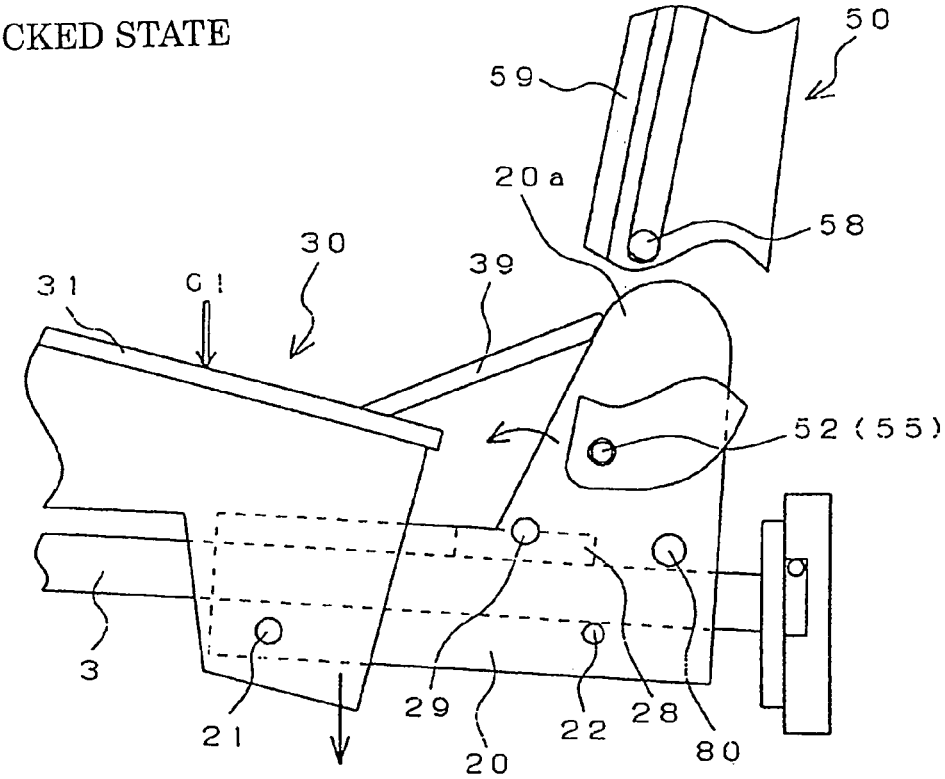
FIGS. 8(A)(B) are explanatory views of the function of the chair in the second embodiment.

For the locked state, in the same manner as in the first embodiment, when the load G1 is applied to the seat member 30, the front roller 21 (guide members 20) moves downwards, and the back roller 22 and brake shoe 28 constituting the lock means assume the held state and locked state with respect to the bottom plate 3 (FIG. 8(A)).

Unlocked State

Figure 8B:
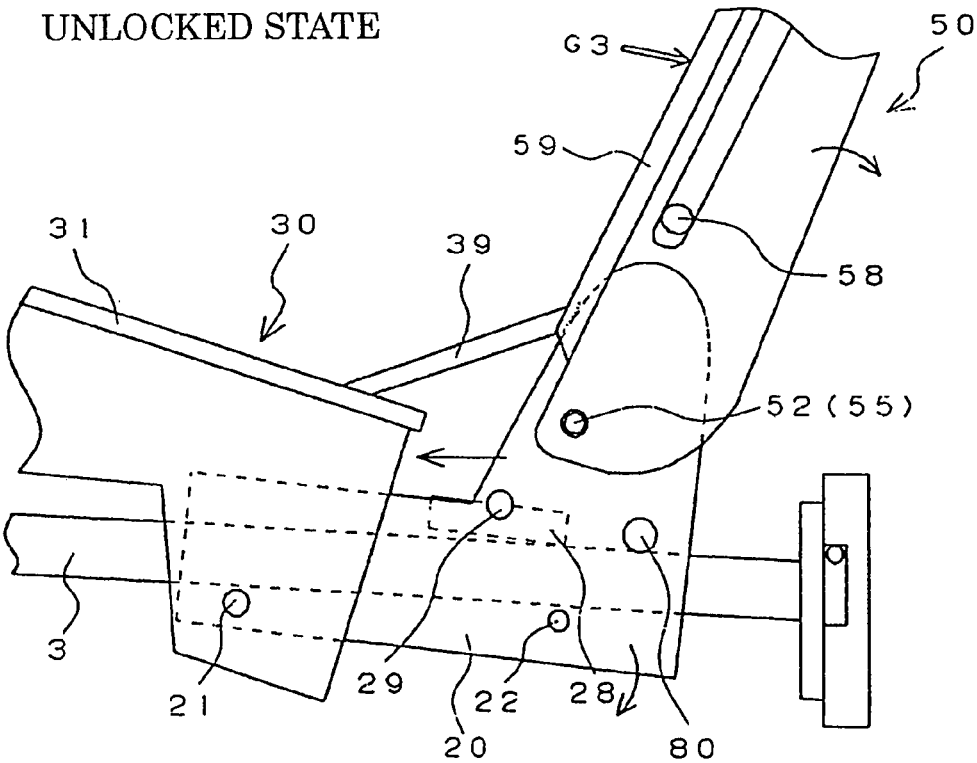

When the back member 50 is pushed by the back, the guide members 20 rotate in the clockwise direction via the axial member 55 by the load G3, the auxiliary roller 80 abuts on the surface of the bottom plate 3, and the front roller 21 abuts on the back surface of the bottom plate, but the brake shoe 28 is brought into the state in which the surface of the bottom plate 3 is not pressed and into the unlocked state (FIG. 8(B)).

Figure 10:
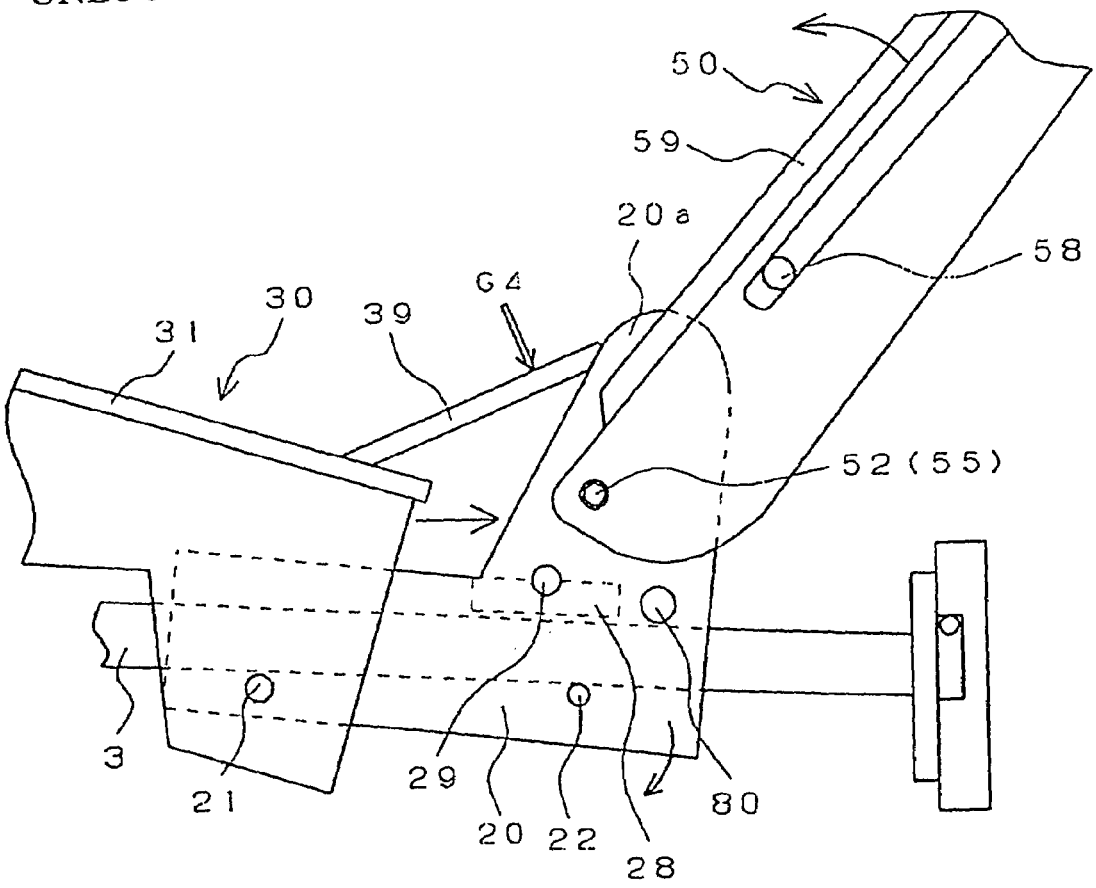
FIG. 10 is an explanatory view of the function of the chair in the second embodiment.

Alternatively, as shown in FIG. 10, when the load G4 is applied to the connection plate 39, the guide members 20 rotate in the clockwise direction, the auxiliary roller 80 abuts on the surface of the bottom plate 3, and the front roller 21 abuts on the back surface of the bottom plate, but the brake shoe 28 is brought into the state in which the surface of the bottom plate 3 is not pressed and into the unlocked state.

Next, the method of using the chair will be described with respect to the respects different from those of the first embodiment with reference to FIGS. 7 to 10.

Figure 7:
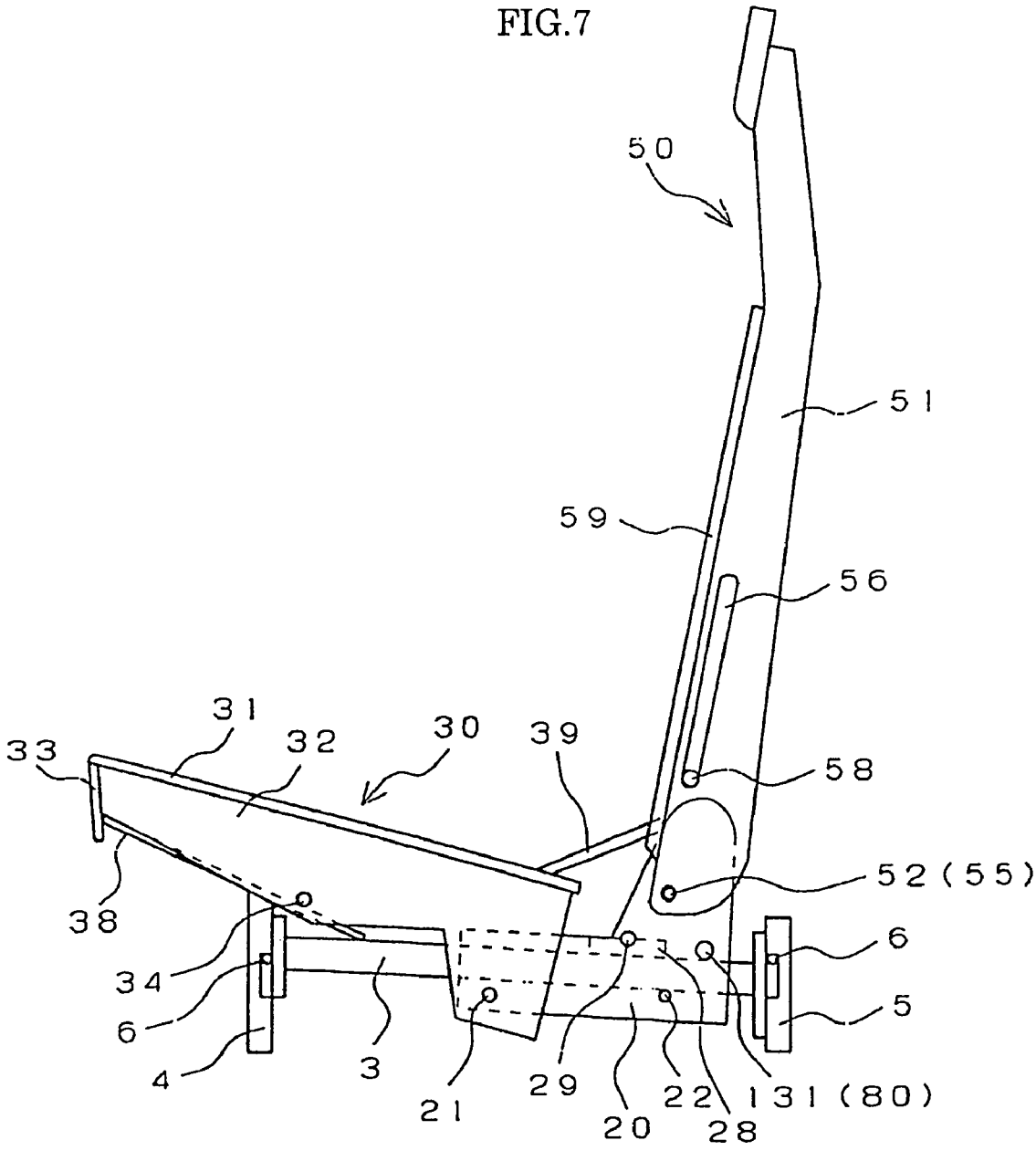
FIG. 7 is a diagram showing the back member in a vertical posture in a second embodiment.

When the back member 50 has the vertical posture as shown in FIG. 7, and when the person sits on the seat member 30, the load G1 is applied to the seat member 30, and the locked state is maintained (FIG. 8(A)).

Next, when the back member 50 is pushed by the back, the guide members 20 rotate in the clockwise direction by the load G3 with the rotation of the back member 50 in the clockwise direction, the auxiliary roller 80 abuts on the bottom plate 3, and the front roller 21 abuts on the back surface of the bottom plate 3 to obtain the unlocked state (FIG. 8(B)).

Subsequently, when the back member 50 is inclined via the axial member 55, the auxiliary roller 80 and front roller 21 rotate while moving the guide members 20 in the forward direction. Therefore, the seat member 30 also moves forwards, and assumes the inclined posture at the arbitrary angle (FIG. 9).

Figure 9:
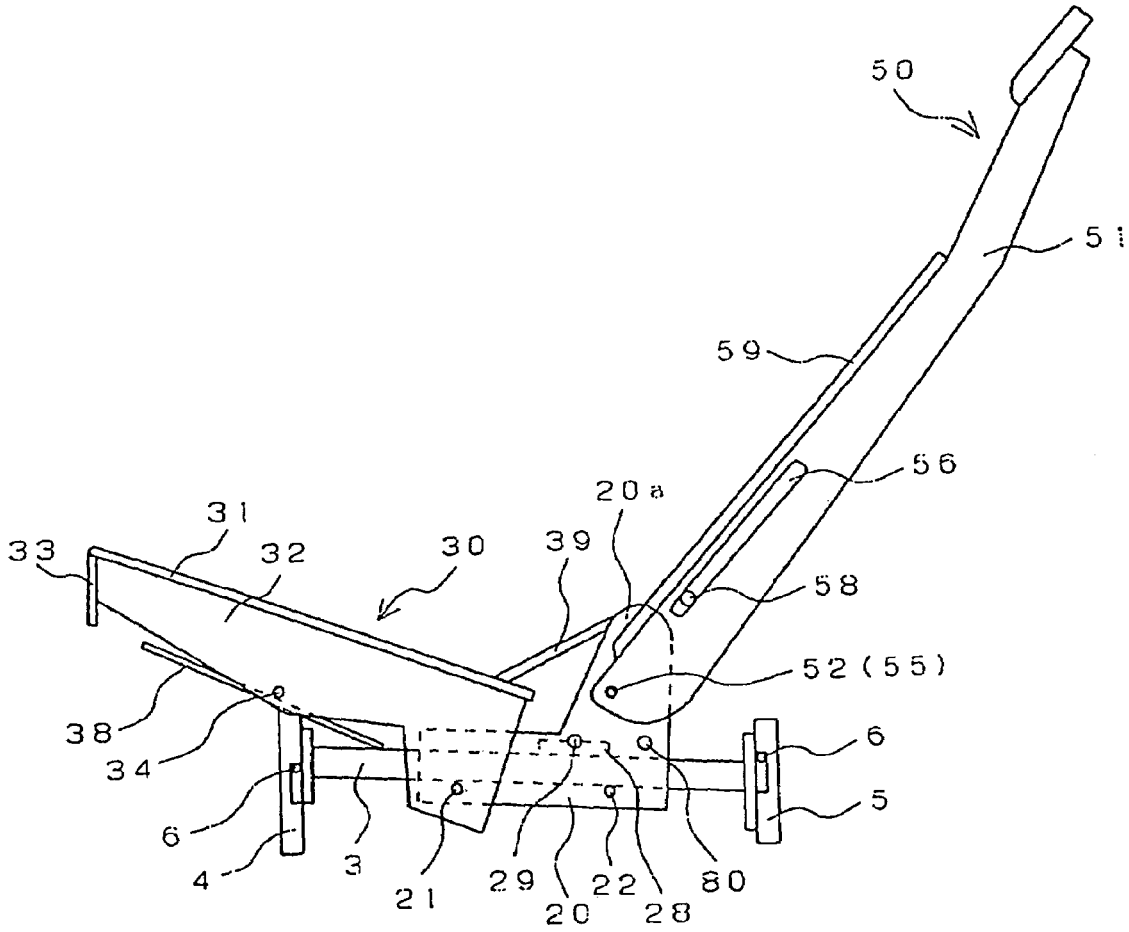
FIG. 9 is a diagram of the back member in the inclined posture in the second embodiment.

Next, after the back member 50 is inclined at the predetermined angle, the person presses down the seat member 30 with the hip, and the locked state is then obtained by the load G1 (FIGS. 9. 8(A)). Therefore, the person can Sit on the chair with the posture at the arbitrary angle (in the inclined state).

Next, when the person sits up from the inclined posture (comfortable posture) of the back member 50. In the first embodiment, the load G2 (see FIG. 6) is applied to the front of the seat member 30 (toward the front plate 33).

However, skills are required for applying the load G2. Therefore, as shown in FIG. 10, the load G4 is applied to the connection plate 39 (the plate is pressed by the hip).

That is, when the load G4 is applied to the connection plate 39 (the plate is pressed by the hip), the guide members 20 rotate in the clockwise direction, and the auxiliary roller 80 is laid on the bottom plate 3 to obtain the unlocked state. Moreover, when the auxiliary roller 80 is rotated, and the guide members 20 are moved in the backward direction by the load G4, the back member 50 shifts to the vertical direction (FIG. 10). Thereafter, when the person sits up via the armrest parts 11, the load G2 functions in the position shown in FIG. 6 to obtain the unlocked state, and the back member 50 successively comes close to the vertical posture.

Moreover, at this time, as shown in FIG. 7, since the bottom plate 3 is formed in the front-rising inclined state to extend to the front plate 4 from the back plate 5, the movement of the guide members 20 in the backward direction is further facilitated. When the elastic member 61 is attached, an assisting force functions, and the vertical state is preferably smoothly attained.

Subsequently, when the back member 50 reaches the predetermined angle, and the load G1 is applied to the seat member 30, the locked state is obtained, and the original posture can be returned (FIG. 8(A)).

As described above, when the back member 50 shifts to the vertical state from the comfortable state, in a former stage, the load G4 is applied to the connection plate 39 to roll the auxiliary roller 80 in the unlocked state, and in a latter stage, the unlocked state is obtained by the load G2. Accordingly, the guide members 20 can easily move in the backward direction, and the back member 50 can easily be changed to the vertical posture (sit up) from the inclined posture (comfortable posture).

Moreover, instead of applying the load G4 to obtain the unlocked state, when the person raises the hip a little to push the tip end of the seat member 30 in the backward direction with the leg. Accordingly, the unlocked state is obtained, and the back member 50 can be shifted to the vertical posture from the inclined posture.

It is to be noted that it can appropriately be selected in accordance with the use whether the auxiliary roller 80 in the second embodiment is disposed and the bottom plate 3 is formed in the front-rising inclined state.

THIRD EMBODIMENT

The present embodiment is the same as the second embodiment except that the shape of the roller plate 38 is different and the bottom plate 3 is constituted in a descending inclined state toward the back plate 5 from the front plate 4. Therefore, only the different respects will be described.

Figure 11:
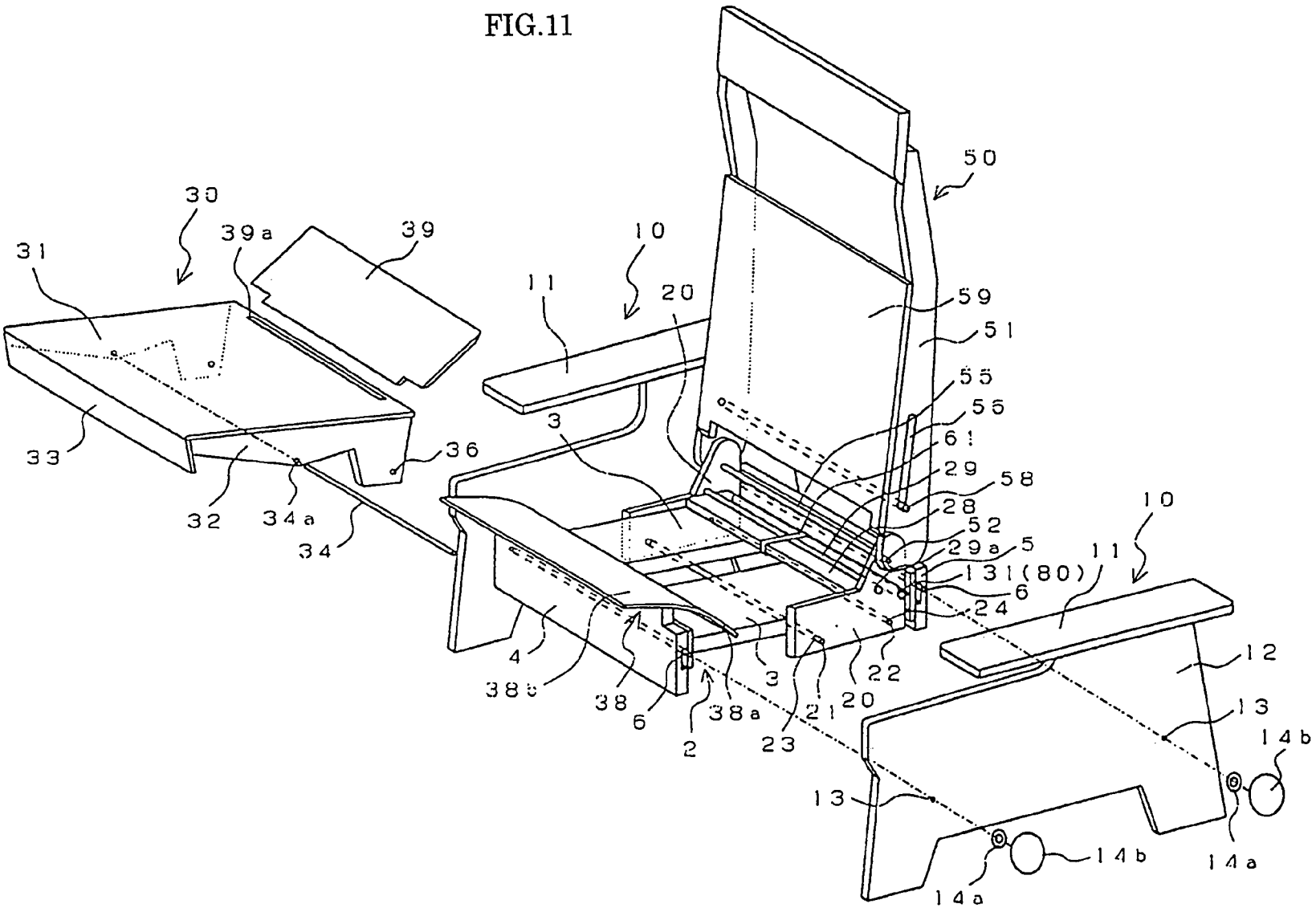
FIG. 11 is a constituting component diagram of the chair in a third embodiment.

As shown in FIG. 11, the roller plate 38 is formed in a convex curved state, and disposed in the front-rising inclined state to extend to the top of the front plate 4 from the bottom plate 3. It is to be noted that a rear side 38*a* in the roller plate 38 is formed to be steep in the inclination as compared with a front side 38*b*.

Next, the function of the convex curved state of the roller plate 38 will be described. The followings in the second embodiment are the same, and the description thereof is omitted:

the looked state shown in FIG. 8(A);

the unlocked state shown in FIG. 8(B); and

"after the back member 50 is inclined at the predetermined angle, and when the person presses down the seat member 30 with the hip, the locked state is obtained by the load G1" shown in FIGS. 9, 8(A).

Moreover, the present embodiment is also the same in (d) to sit up from the inclined posture (comfortable posture) of the back member 50, the load G4 is applied to the connection plate 39 (the plate is pressed by the hip) to sit up. However, after this function, when the back member 50 approaches the vertical state, it becomes difficult to apply the load G4 to the connection plate 39.

To solve the problem, the rear side 38*a* of the roller plate 38 is formed at the steep angle. Therefore, when the seat member roller 34 reaches the corresponding portion, the seat member 30 easily moves downwards in the backward direction by the person's weight. With the downward movement, the guide members 20 move in the backward direction, and the back member 50 shifts to the vertical posture. Moreover, also since the bottom plate 3 is constituted in the descending inclined state toward the back plate 5 from the front plate 4, the guide members 20 can smoothly move in the backward direction. Therefore, at least one constitution is preferably employed.

That is, to sit up from the inclined posture (comfortable posture) of the back member 50 (obtain the vertical posture), in the second embodiment, the load G2 needs to be applied following the load G4. However, in the present embodiment, when the load G4 is applied, the guide members 20 thereafter smoothly move in the backward direction to bring the back member 50 into the vertical posture.

FOURTH EMBODIMENT

For the present embodiment, in the constitution of the reclining apparatus according to the first to third embodiments, the brake shoe 28 can contact the back surface of the bottom plate 3. This will be described with reference to FIGS. 12, 13. It is to be noted that the components performing the same functions as those in the reclining apparatus according to the first to third embodiments are denoted with the same reference numerals, and the detailed description is omitted.

In this reclining apparatus, the connection plate 39 can be constituted separately from the hip plate 31. Here, the connection plate 39 is extended and formed integrally with the hip plate 31 to constitute a hip plate 31A.

Moreover, the brake shoe 28 having the flat plate shape is attached on the back-surface side of the bottom plate 3 so that the back roller 22 can slide/rotate on the front-surface side of the bottom plate 3, that is, the positions of the lock rod 29 and back roller 22 in the first to third embodiments are alternately changed. The conditions for achieving the locked state and unlocked state are the same.

Furthermore, the function of the reclining apparatus in the above-described constitution will be described.

Figure 12A:
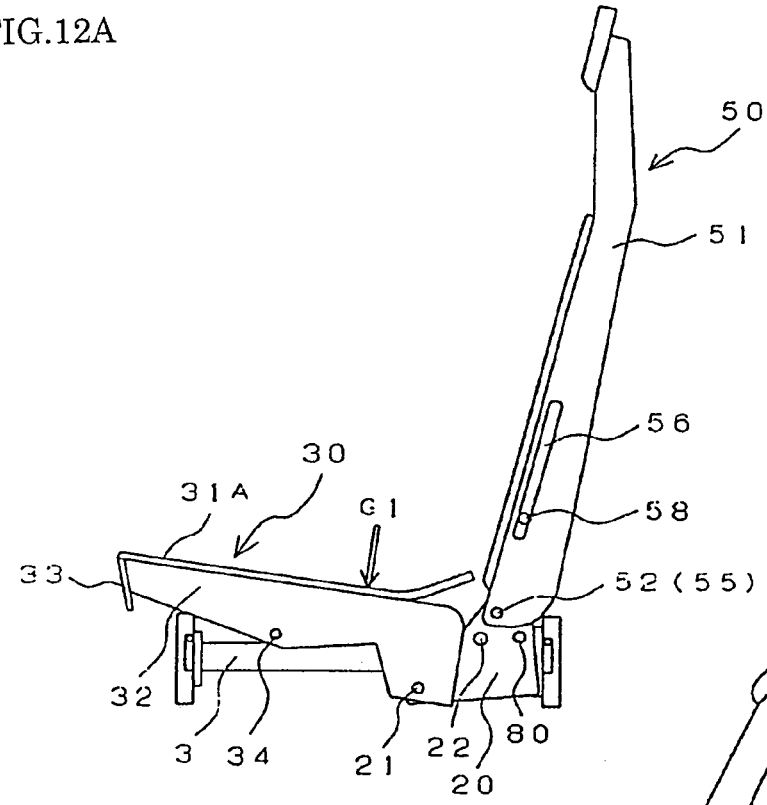
FIGS. 12(A) to (C) are posture diagrams of the back member in a fourth embodiment.
Figure 13A:
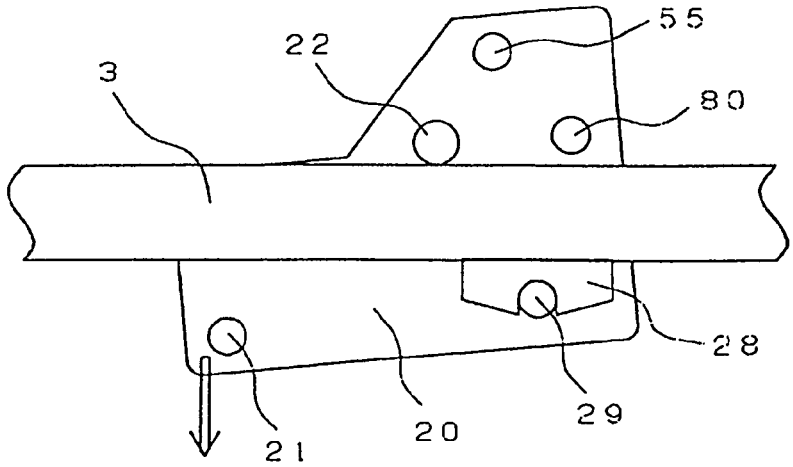
FIG. 13 is an explanatory view of the function of the chair in the fourth embodiment.
Figure 13B:
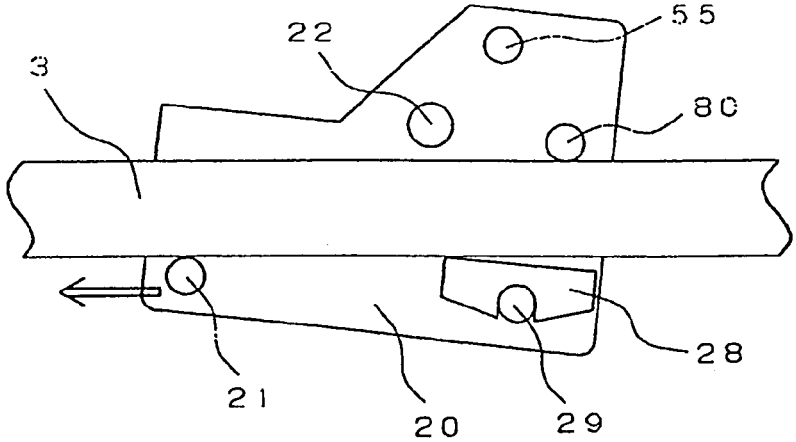
Figure 13C:
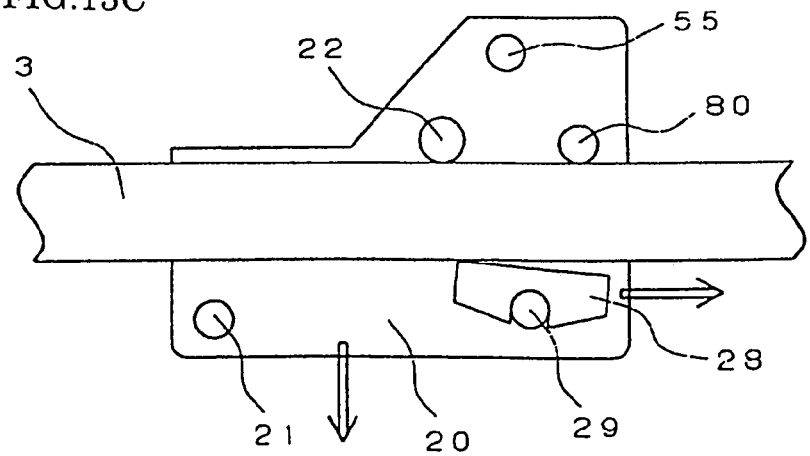

Locked State (FIGS. 12(A), 13(A))

When the person presses down the seat member 30 with the hip, the load G1 is applied on the rear side of the seat member 30, the seat member 30 (front roller 21) slightly moves downwards by the load G1, the guide members 20 rotates in the counterclockwise direction, and the back roller 22 and brake shoe 28 constituting the lock means obtain the held state and locked state with respect to the bottom plate 3.

Figure 12B:
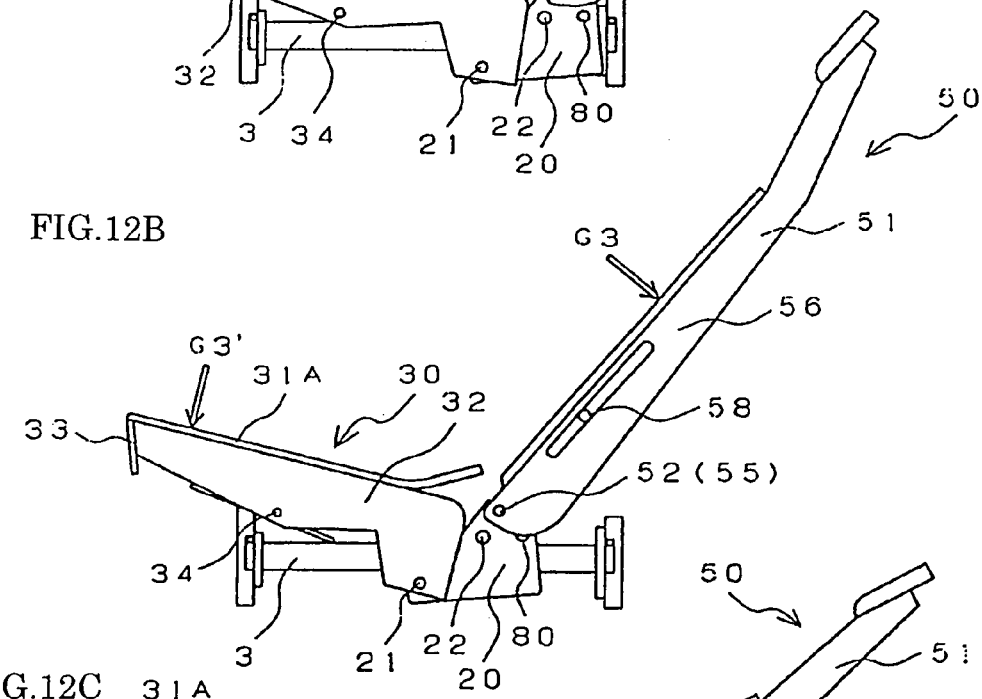

Unlocked State (FIGS. 12(B)(C), 13(B)(C))

To obtain the unlocked state, the load is applied not to obtain the above-described locked state. That is, this can be achieved by the load applied so that the back roller 22 and brake shoe 28 corresponding to the lock means do not have the held state with respect to the bottom plate 3.

When the back member 50 is pushed by the back (load G3), and a load G3' is applied on the front side of the seat member 30 (toward the front plate 33), the guide members 20 rotate in the clockwise direction by the load G3', and the guide members 20 are moved in the forward direction by the load G3. Therefore, the auxiliary roller 80 abuts on the surface of the bottom plate 3, the front roller 21 abuts on the back surface of the bottom plate 3, and the brake shoe 28 is brought in the state of not pressing the surface of the bottom plate 3 and into the unlocked state.

Therefore, the back member so is successively inclined to shift to the state of FIG. 12(B) from that of FIG. 12(A). When the person presses down the seat member 30 with the hip in this inclined state, the member is locked in the comfortable state (FIG. 12(B)). Similarly, when the back member 50 is pushed by the back in the comfortable state (FIG. 12(B)), the back member 50 is further inclined by the load G3, and the comfortable state (FIG. 12(C)) is obtained. When the person presses down the guide members 20 with the hip in this state, the member is locked in this state.

Alternatively, when the load G2 is applied on the rear side of the seat member 30 (the side of the brake shoe 28), the back roller 22 and auxiliary roller 80 abut on the surface of the bottom plate 3, and the brake shoe 28 is brought into the unlocked state not to press the back surface of the bottom plate 3. Moreover, the guide members 20 are moved in the backward direction to change the back member 50 to the vertical state from the comfortable state.

Figure 12C:
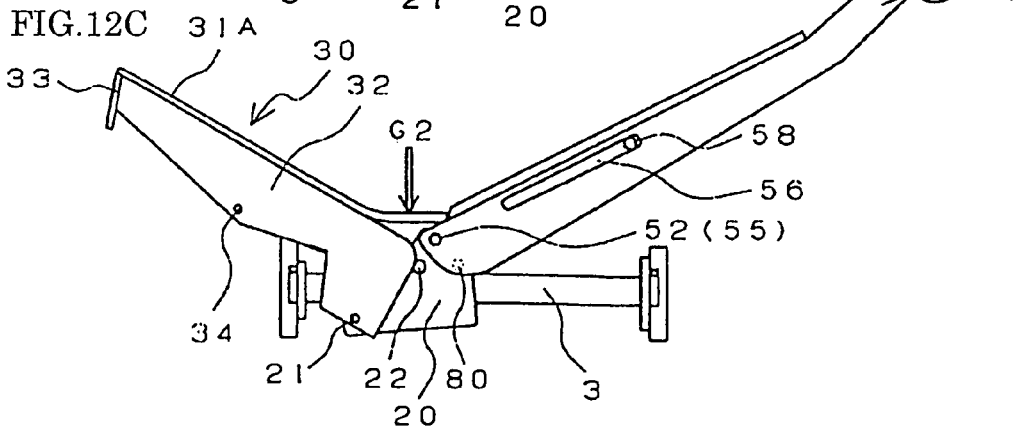

That is, the back member 50 is successively inclined in the vertical direction, and changes to the state of FIG. 12(B) from that of FIG. 12(C). When the person presses down the seat member 30 with the hip in this inclined state, the member is locked In the state of FIG. 12(B). Similarly, when the load G2 is applied in the state of FIG. 12(B), the back member 50 is successively inclined in the vertical direction, and the state of FIG. 12(B) shifts to that of FIG. 12(A). When the person presses down the seat member 30 with the hip in this state, the member is locked in the state of FIG. 12(A).

As described above, the brake shoe 28 may also be formed in such a constitution to abut on the back surface of the bottom plate 3.

FIFTH EMBODIMENT

Figure 14:
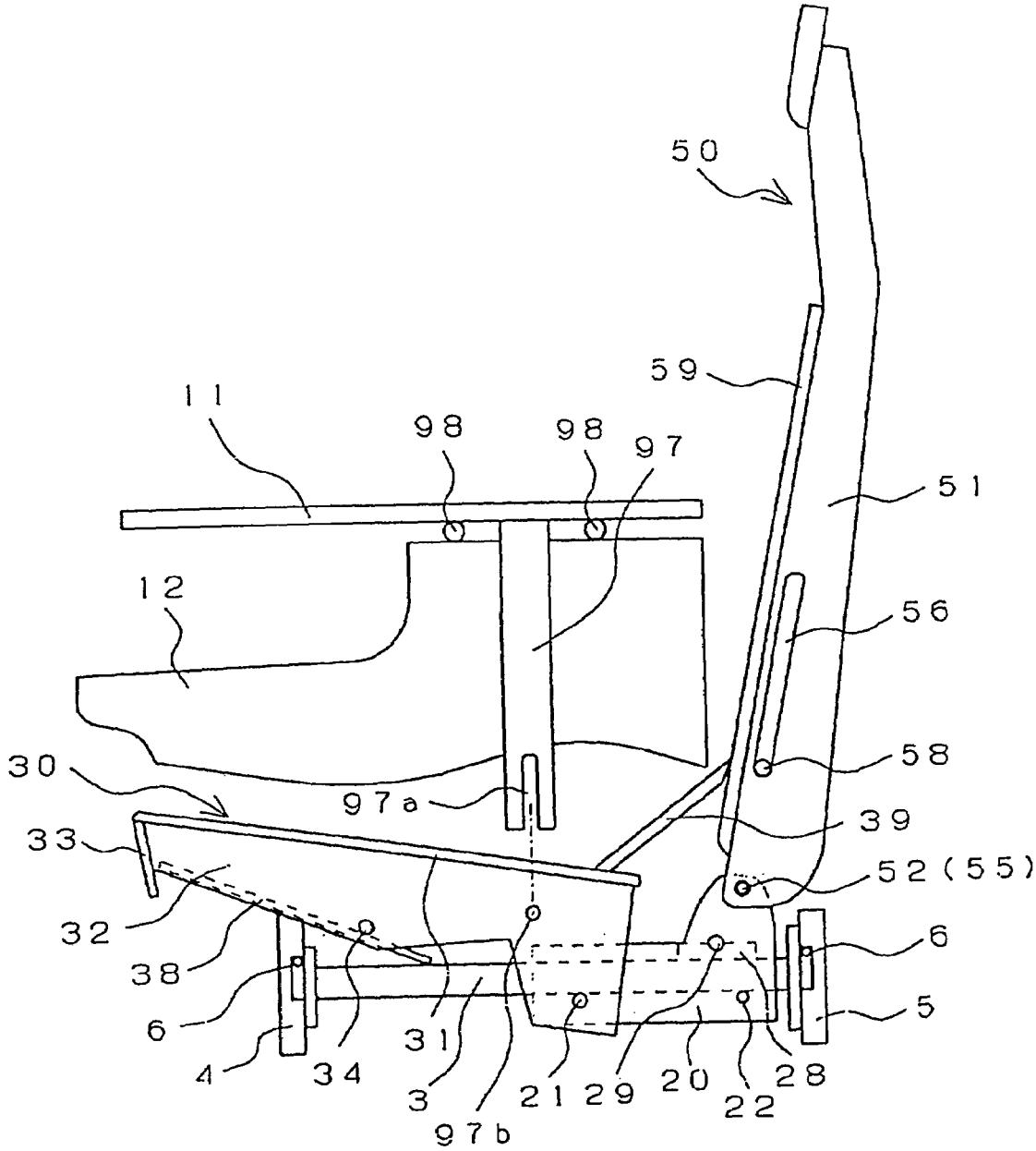
FIG. 14 is a diagram showing a concept of the chair in a fifth embodiment.

Next, FIG. 14 is a schematic diagram of the constitution in which the back member 50 can more easily be changed to the vertical state from the comfortable state or to the comfortable state from the vertical state. It is to be noted that in the reference numerals of the components shown in FIG. 14, for the same reference numerals as those of FIG. 3 in the first embodiment, the description is omitted.

The armrest parts 11 can move forwards/backwards via rollers 98 with respect to the foot members 12. Moreover, a connection member 97 is attached to the armrest part 11, and a guide groove 97*a* is formed in this connection member 97.

On the other hand, a projection rod 97*b* which can be mounted in the guide groove 97*a* is disposed in the side plate 32. Since the projection rod 97*b* is mounted to the guide groove 97*a*, the armrest parts 11 and side plates 32 (seat member 30) move forwards/backwards together.

Therefore, in this constitution of the reclining apparatus, when the person raises the hip a little (unlocked state) to move the armrest parts 11 forwards/backwards, the side plates 32 (seat member 30) also move forwards/backwards. Then, when the back member 50 is changed to the vertical state from the comfortable state, the armrest parts 11 are moved in the backward direction. When the back member 50 is changed to the comfortable state from the vertical state, the armrest parts 11 may be moved in the forward direction, and the state can easily be changed.

It is to be noted that the guide groove 97*a* is formed in an elongated groove, and allows the vertical movement of the side plates 32 (seat member 30). Moreover, the reclining apparatus is constituted such that the side plates 32 (seat member 30) can move forwards/backwards via the connection member 97, but may also be constituted such that the guide members 20 can move forwards/backwards via the connection member 97.

As described above, in the reclining apparatus of the present invention, the seat member 30 can smoothly move straight forwards/backwards by the front roller 21, back roller 22, or auxiliary roller 80 which rolls on the whole surface of the bottom plate 3. Moreover, when the position of the load by the person is varied, the locked state and unlocked state can be changed via the rocking of the guide members 20. This is a considerably simple mechanism, and this structure can be applied not only to the chair but also to various fields such as a bed.

It is to be noted that In the operation of the reclining apparatus of the present invention, the person may raise the hip a little to obtain the unlocked state, and move the seat member 30 with the foot, and the like, or move the armrest parts 11 backwards to change the back member 50 to the vertical state from the comfortable state by this operation.

SIXTH EMBODIMENT

Figure 15A:
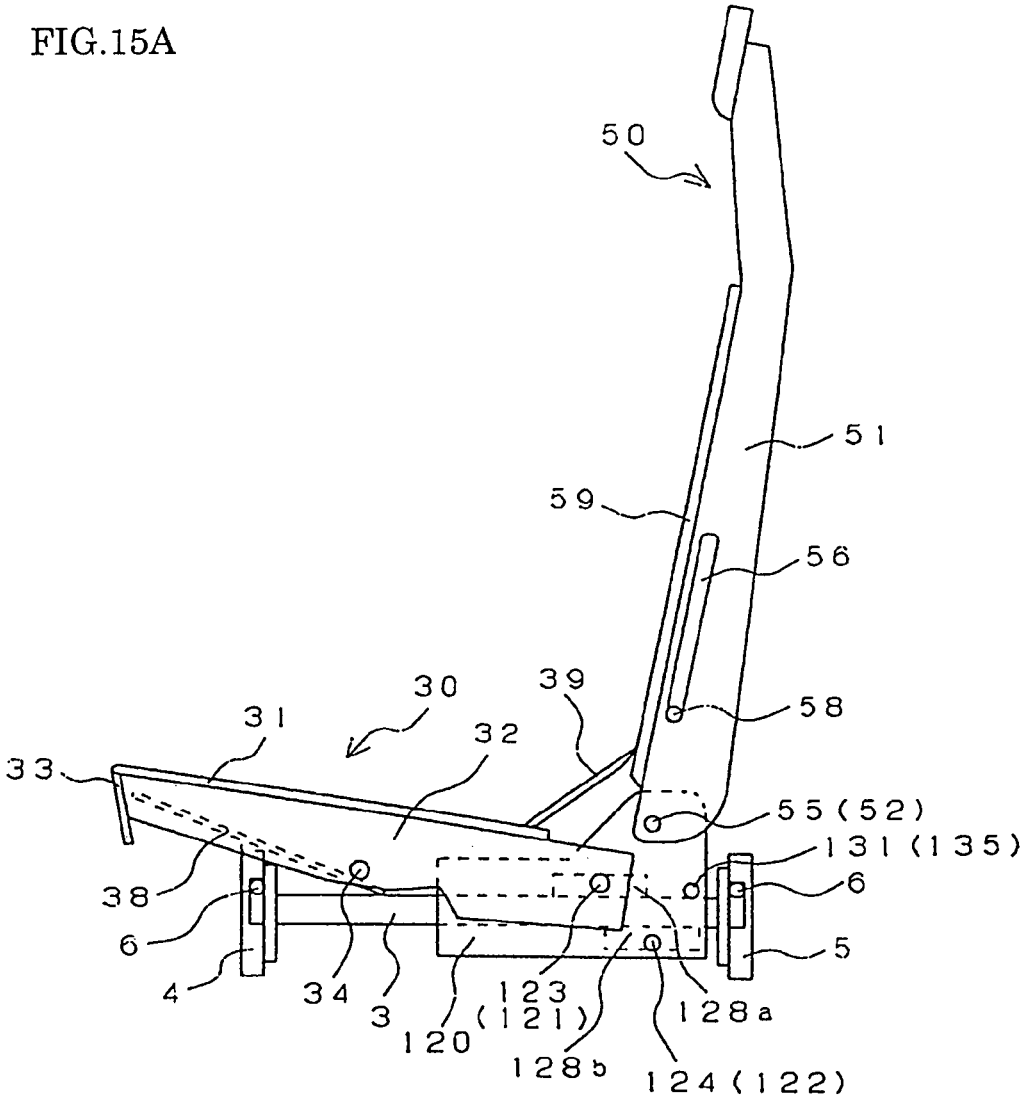
FIG. 15 shows the chair in a sixth embodiment, (A) is a front view of the chair from which foot members are removed, and (B) is a front partial view showing that side plates are cut.
Figure 15B:
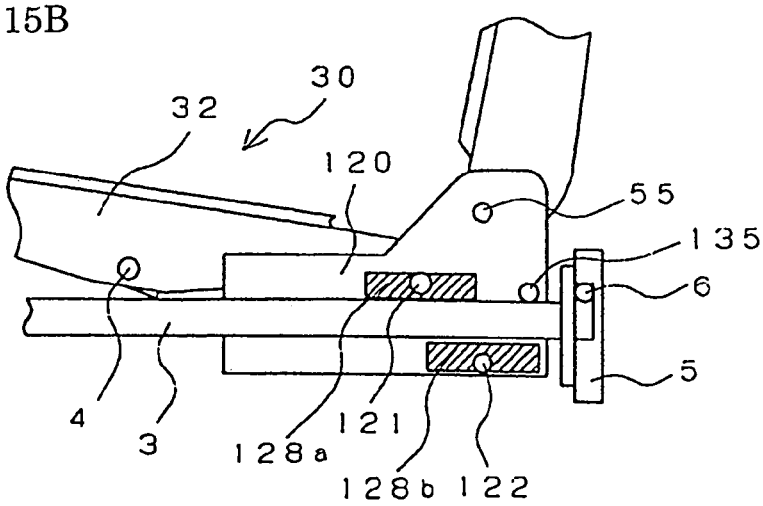

The reclining apparatus of the present embodiment is different from the first to fifth embodiments in a load position in shifting to the locked or unlocked state. The constitution will be described with reference to a front view of the chair from which the foot members 12 are removed (FIG. 15(A)), a partial front view in which a part of the side plate 32 is cut (FIG. 15(B)), and FIGS. 16(A)(B) showing a sectional front view showing the function. It is to be noted that the members performing the same functions as those of the above-described embodiments are denoted with the same reference numerals and the description thereof is omitted.

On the opposite left/right sides of the bottom plate 3, one pair of guide members 120 having the arbitrary shapes, and L-shapes herein are attached so as to be movable forwards/backwards by the auxiliary roller 135 described later in the same manner as in the second embodiment.

Moreover, one pair of guide members 120 include holes (not shown), disposed on the front-surface side of the bottom plate 3, for passing a front press member 121 described later, and one pair of bearings 124 positioned on the back-surface side of the bottom plate 3 are attached at an appropriate distance on the rear side of the front press member 121.

That is, for the attachment positions described later in detail, the above-described holes (bearings 123 described later, and front press member 121) and the bearings 124 (back press member 122) are disposed in the positions where the bottom plate 3 can be held via the upper brake shoe 128*a* and lower brake shoe 128*b* constituting the lock means in the locked state by the rocking of the guide members 120 and a gap (δ1, δ2) from the bottom plate 3 can be formed in the unlocked state.

Moreover, one pair of bearings 123 to which the front press member 121 is attached are attached to the side plates 32 of the seat member 30.

Furthermore, the connection plate 39 is inserted in the inclined state in the elongated hole 39*a* formed in the rear end of the surface of the seat member 30, and the other end is reclined on the back plate 59 of the back member 50 and brought into an abutment state to fill in the lower gap between the seat member 30 and back plate 59. Additionally, the connection plate 39 moves forwards/backwards together with the seat member 30, while the upper end abuts on the back plate 59.

Additionally, the front press member 121 having the round rod shape is attached to the bearings 123 attached to the side plates 32 in such a manner that the upper brake shoe 128*a* having the flat plate shape and capable of contacting the surface of the bottom plate 3 can be pressed, and the guide members 120 and seat member 30 can move forwards/backwards together.

Moreover, the back press member 122 having the round rod shape is attached to the bearings 124 in such a manner that the lower brake shoe 128*b* having the flat plate shape and capable of contacting the back surface of the bottom plate 3 can be pressed.

In one pair of guide members 120, the auxiliary rollers 135 are rotatably and transversely disposed via the bearings 131 on the rear side of the axial member 55 described later so that the rollers can slide/rotate on the whole surface on the front-surface side of the bottom plate 3.

The auxiliary roller 135 is attached to the position where the gap (δ1) is generated between the upper brake shoe 128*a* and the surface of the bottom plate 3 and the small gap (δ2) is generated between the lower brake shoe 128*b* and the back surface of the bottom plate 3 under the load produced when the person sits on the seat member 30. Moreover, the roller is attached to the bearing 131 so as to be slidable/rotatable on the front-surface side of the bottom plate 3, and therefore the forward/backward movement including the smooth rectilinear properties of the guide members 120 is possible (FIG. 16(A)).

Moreover, the axial member 55 for connecting one pair of guide members 120 to the back member 50 is disposed in a substantially vertical position above the back press member 122 (bearings 124).

Next, the function of the above-described constitution will be described with reference to FIG. 16(A)(B).

Figure 16A:
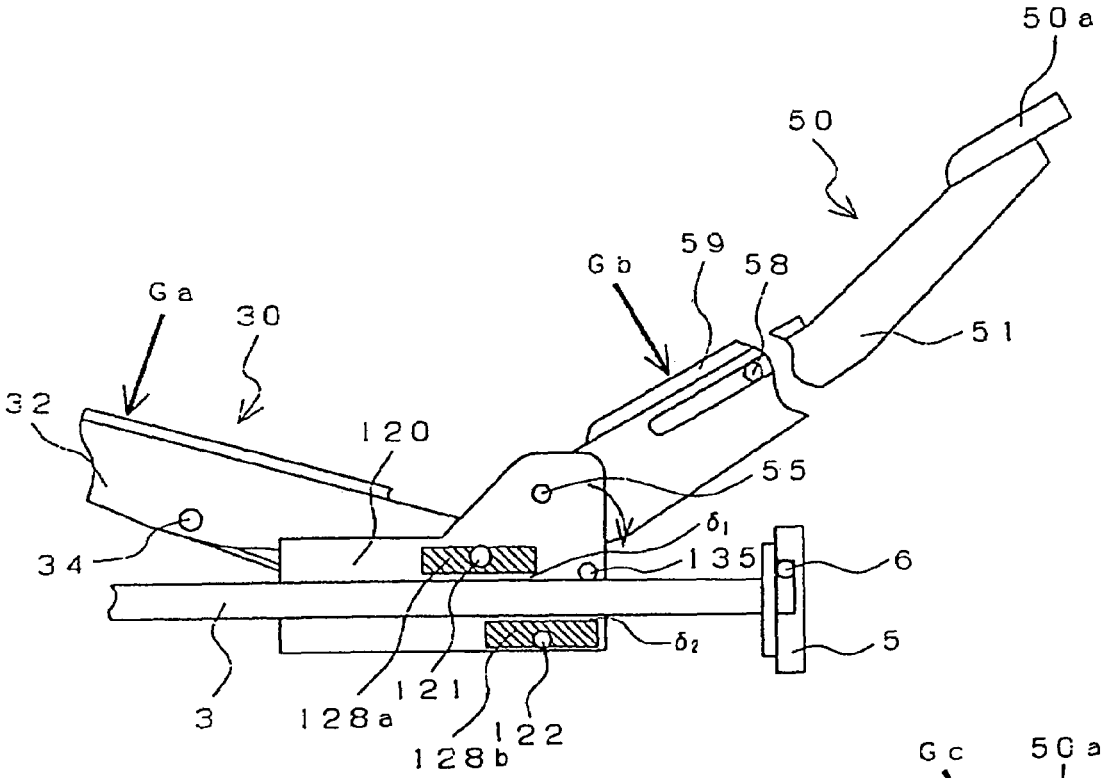
FIGS. 16(A)(B) are explanatory views of the function of the chair in the sixth embodiment.

FIG. 16(A) shows the posture in which the person sits on the seat member 30 and the seat member 30 is inclined to the comfortable state from the vertical state.

At this time, a downward load Ga applied to the seat member 30, and a press load Gb for pressing and inclining the back member 50 by the hip below the back plate 59 are supported by the seat member roller 34 and auxiliary roller 135 via the guide members 120. The guide members 120 are rotated in the clockwise direction on the transverse support member 58 which is a support point, and at least the downward load is not applied to the upper brake shoe 128*a* to form the gap (δ1). On the other hand, the small gap (δ2) is generated between the lower brake shoe 128*b* and bottom plate 3, and the upper brake shoe 128*a* and lower brake shoe 128*b* are brought into the unlocked state in which the bottom plate 3 is not held.

Subsequently, the back member 50 is reclined by the press load Gb for inclining the back member 50. Moreover, the load directed toward the axial member 55 acts on the back member 50, the auxiliary roller 135 and seat member roller 34 are rotated, and the guide members 120 and seat member 30 are moved forwards. As a result, the back member 50 successively shifts to the inclined state (comfortable state).

Figure 16B:
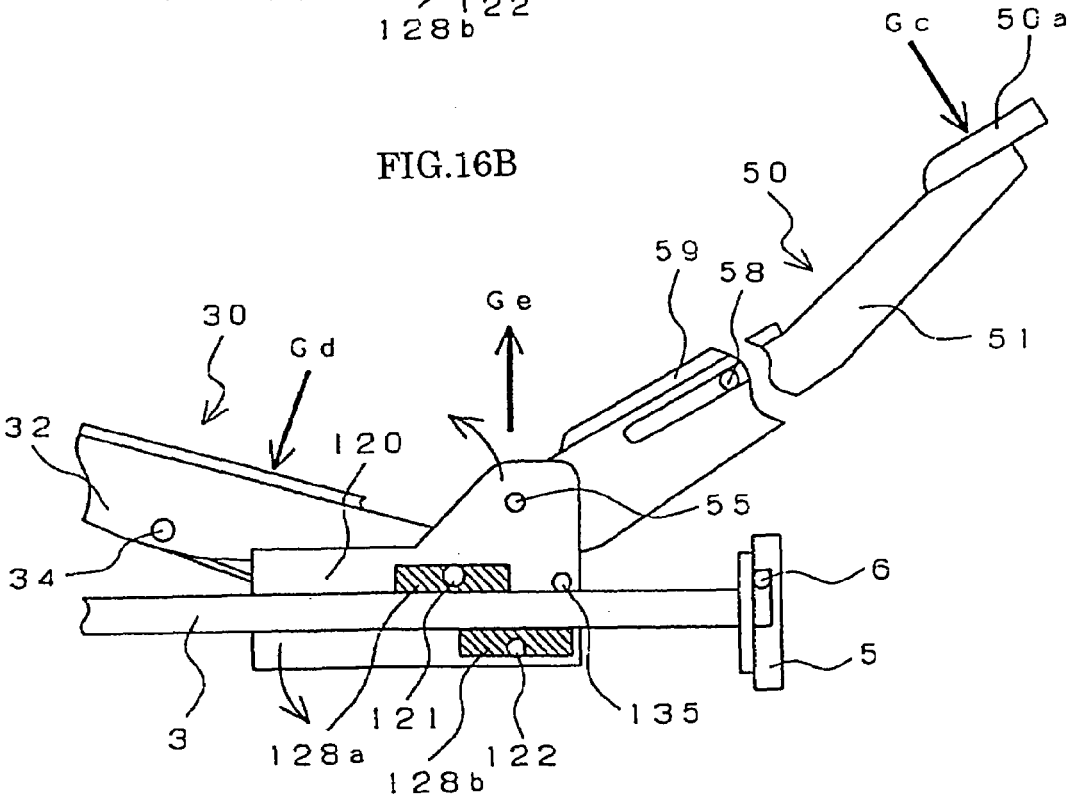

Next, when the back member 50 is inclined at the predetermined angle, to obtain the locked state, as shown in FIG. 16(B), a load Gc is applied to a pillow member 50*a* disposed on the top of the back member 50 by the head. Then, an upward load Ge acts on the axial member 55 in an upward direction on the transverse support member 58 which is the support point, and a downward load Gd acts on the seat member 30 on the rear side of the seat member roller 34.

Therefore, the downward load is applied to the guide members 120 by the front press member 121. On the other hand, the members receive the rotary momentum of the counterclockwise direction to rock by the upward load Ge, the upper brake shoe 128*a* and lower brake shoe 128*b* constituting the lock means hold the bottom plate 3 to obtain the locked state, and the inclined state of the back member 50 is maintained.

That is, when the person sits on the seat member 30 and, applies the load to the pillow member 50*a* on the top of the back member 50 by the head, the locked state is obtained. When the person detaches the head from the pillow member 50*a* on the top of the back member 50, the unlocked state is obtained.

Moreover, when the person taking a rest sits up from the comfortable state with the inclined back member 50 (locked state) to leave the chair, first the person raises the upper body in the vertical state (detaches the head from the pillow member 50*a* on the top of the back member 50) to obtain the unlocked state. Furthermore, the lower part of the back member 50 is pushed to move the seat member 30 backwards, and the back member 50 is shifted to the vertical state to obtain the state of FIG. 15(A). Then, the person can get up from the chair.

As described above, the reclining apparatus of the sixth embodiment is different from that of the first to fifth embodiments in the load points in the locked and unlocked states.

It is to be noted that both the upper brake shoe 128*a* and lower brake shoe 128*b* are preferably disposed, but one brake shoe may be disposed in consideration of the locked state by the material of the brake shoe. Moreover, when one brake shoe is disposed, in order to hold the bottom plate 3 in the locked state, as shown in the constitution of FIG. 4(A), the press member (roller) may be attached instead of the brake shoe.

SEVENTH EMBODIMENT

Figure 17:
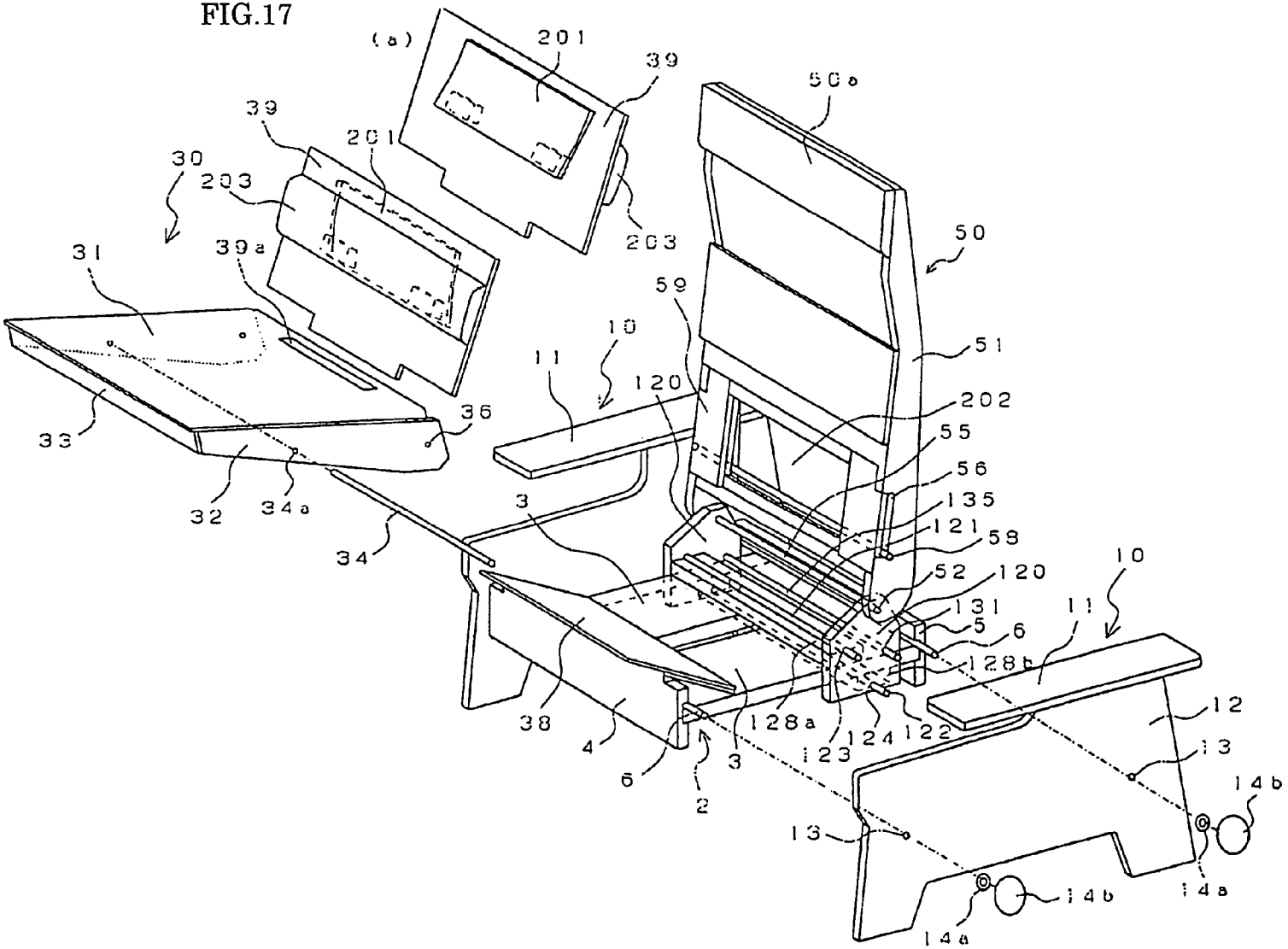
FIG. 17 is a constituting component diagram of the chair in a seventh embodiment.
Figure 18:
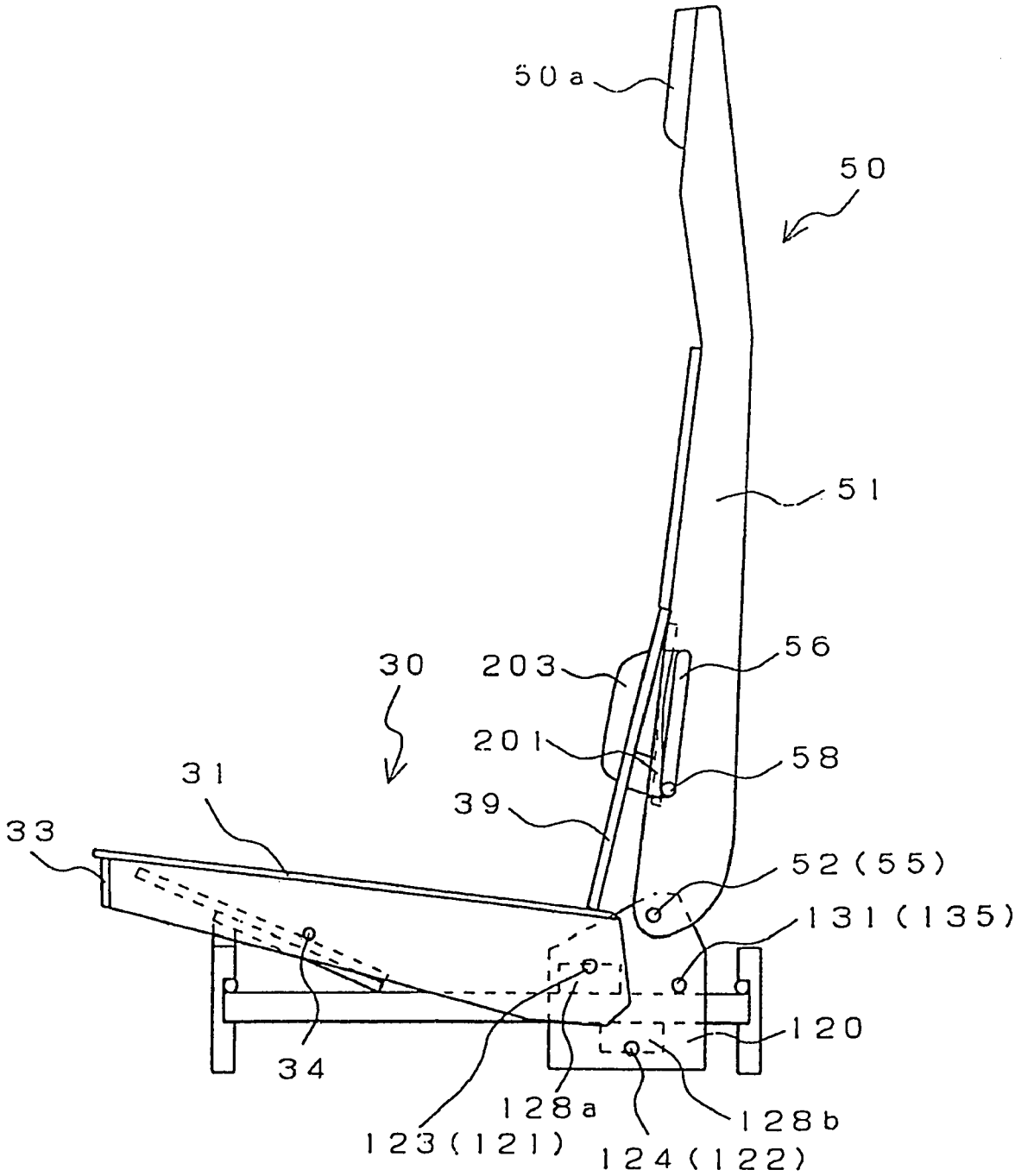
FIG. 18 is a front view of the chair in the seventh embodiment.

The reclining apparatus of the present embodiment is an improved proposal of the sixth embodiment. With respect to an example of application to the chair, the components constituting the chair are shown in FIG. 17, and the front view is shown in FIG. 18. The components performing the same functions as those of the above-described embodiments are denoted with the same reference numerals and the description thereof is omitted.

The seventh embodiment is the same as the sixth embodiment in that the part below the back member 50 (abutment member 203 described later) is pressed in the unlocked state to obtain the comfortable (inclined) state of the back member 50 and that the part above the back member 50 (the pillow member 50*a* on the top) is pressed in the comfortable state to obtain the locked state.

In the seventh embodiment, the constituting components different from those of the sixth embodiment will be described The mountain-shaped abutment member 203 made of a synthetic resin so as to be fitted on the concave portion corresponding to the person's hip is attached to the upper part (the lower position of the back member 50) of the inclined connection plate 39, which fills in the gap between the seat member 30 and back member 50.

Moreover, the back surface of the connection plate 39 is shown in (a). A curved plate 201 formed in a concaved curved surface high in upper and lower portions is attached to the back surface of the connection plate 39 so that the plate can abut on the transverse support member 58 inserted in the cam holes 56 formed in the back support parts 51 of the back member 50. A curved hole 202 is formed in the back plate 59 in such a manner that the curved plate 201 can be mounted in the back plate 59 of the back member 50. It is to be noted that the curved surface formed in the curved plate 201 is formed in a shape extending the inclined posture of the back member 50.

Moreover, the positions of the front press member 121, upper brake shoe 128*a*, back press member 122, lower brake shoe 128*b*, and auxiliary roller 135 are the same as those of the sixth embodiment (FIG. 15), but the axial member 55 connecting one pair of guide members 120 to the back member 50 is disposed above the back press member 122 so as to deviate on the side of the auxiliary roller 135.

Figure 19A:
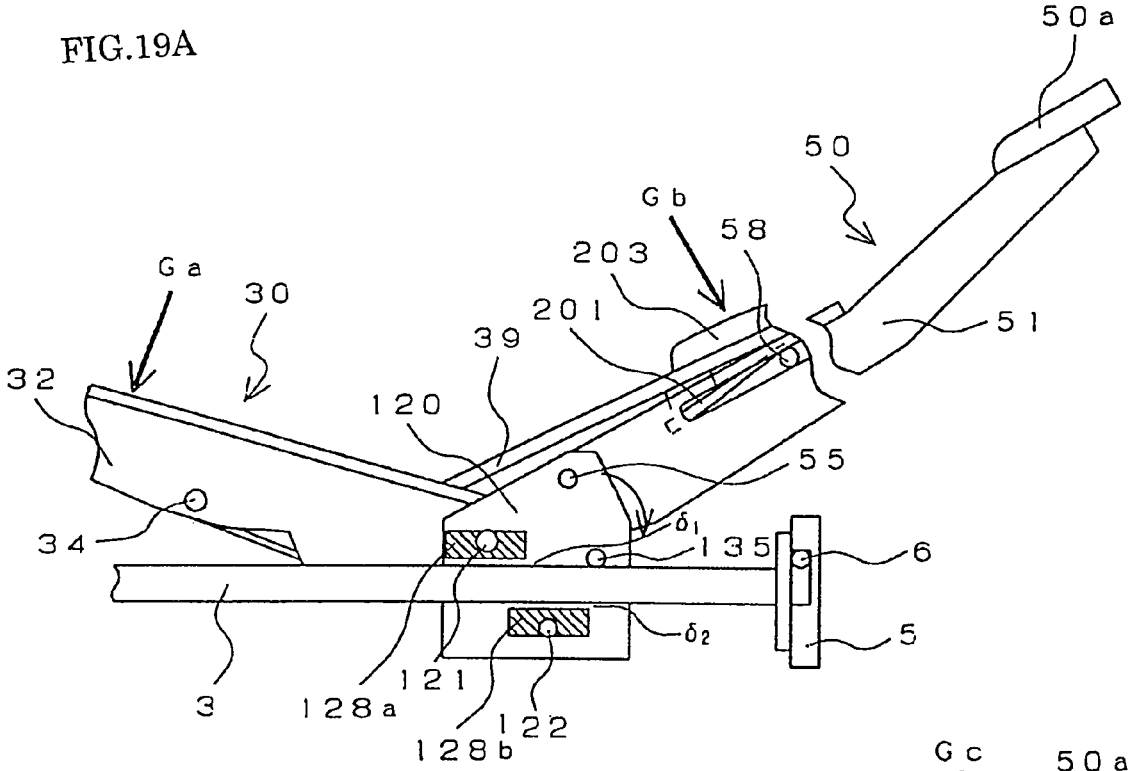
FIGS. 19(A)(B) are explanatory views of the function of the chair in the seventh embodiment.

Next, the function of the chair of the seventh embodiment will be described with reference to FIGS. 19(A)(B).

When the person sits on the seat member 30 to press the abutment member 203 disposed in the connection plate 39 in the lower position of the back member 50 by the hip, the load is applied to the transverse support member 58, and a reclining function acts on the back member 50. Moreover, when this transverse support member 58 (back member 50) is reclined, in the axial member 55 disposed above the back press member 122 so as to slightly deviate on the side of the auxiliary roller 135, the guide members 120 is rotated in the clockwise direction to obtain the unlocked state. The transverse support member 58 slides/rotates on the curved plate 201 to shift the back member 50 to the comfortable state from the vertical state (FIG. 19(A)).

Figure 19B:
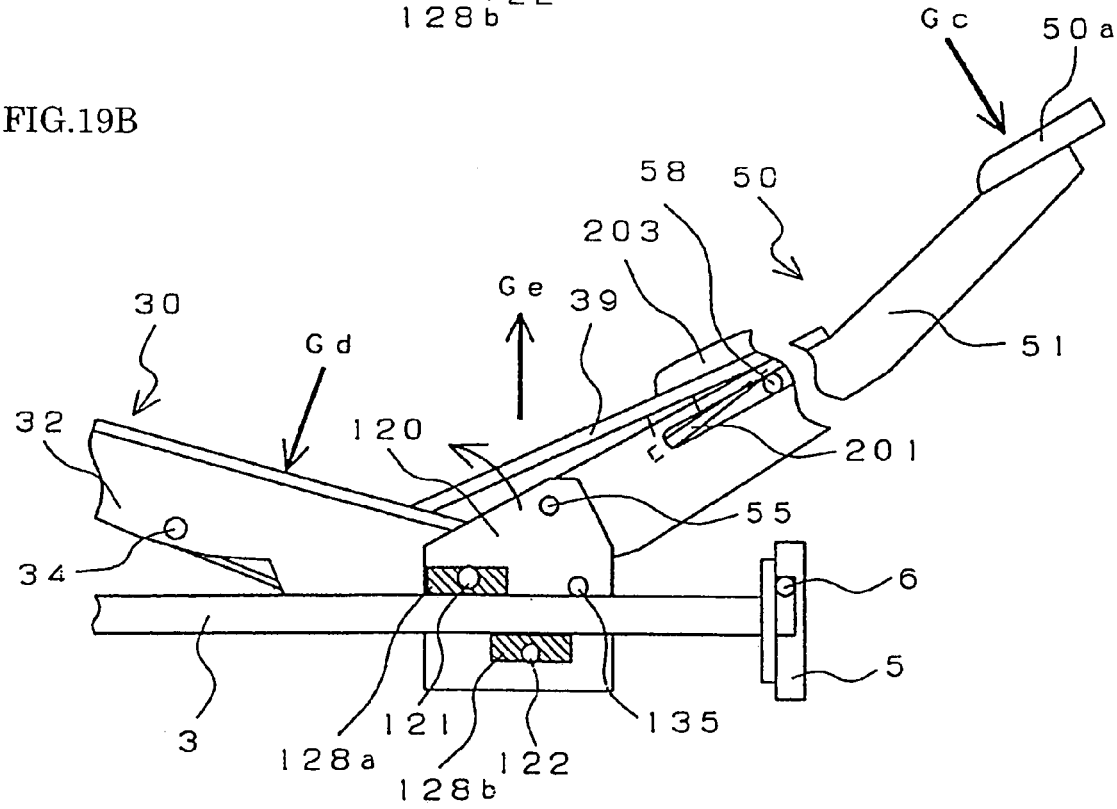

On the other hand, when the load Gc is applied above the back member 50 (the pillow member 50*a* on the top) by the head, the guide members 120 receives the rotary momentum of the counterclockwise direction to rock on the transverse support member 58 which is a base axis. The upper brake shoe 128*a* and lower brake shoe 128*b* constituting the lock means holds the bottom plate 3 in the locked state, and maintains the inclined state of the back member 50 (FIG. 19(B)).

As described above, since the abutment member 203 is disposed in the connection plate 39 in the lower position of the back member 50 in the seventh embodiment, the place to be pressed is clear and is easily pressed as compared With the sixth embodiment. When the abutment member 203 is pressed, the member can incline the back member 50 integrally with the seat member 30 in the unlocked state. When the part above the back member 50 (pillow member 50*a*) is pressed, the locked state is obtained in the inclined state.

EIGHTH EMBODIMENT

Figure 20:
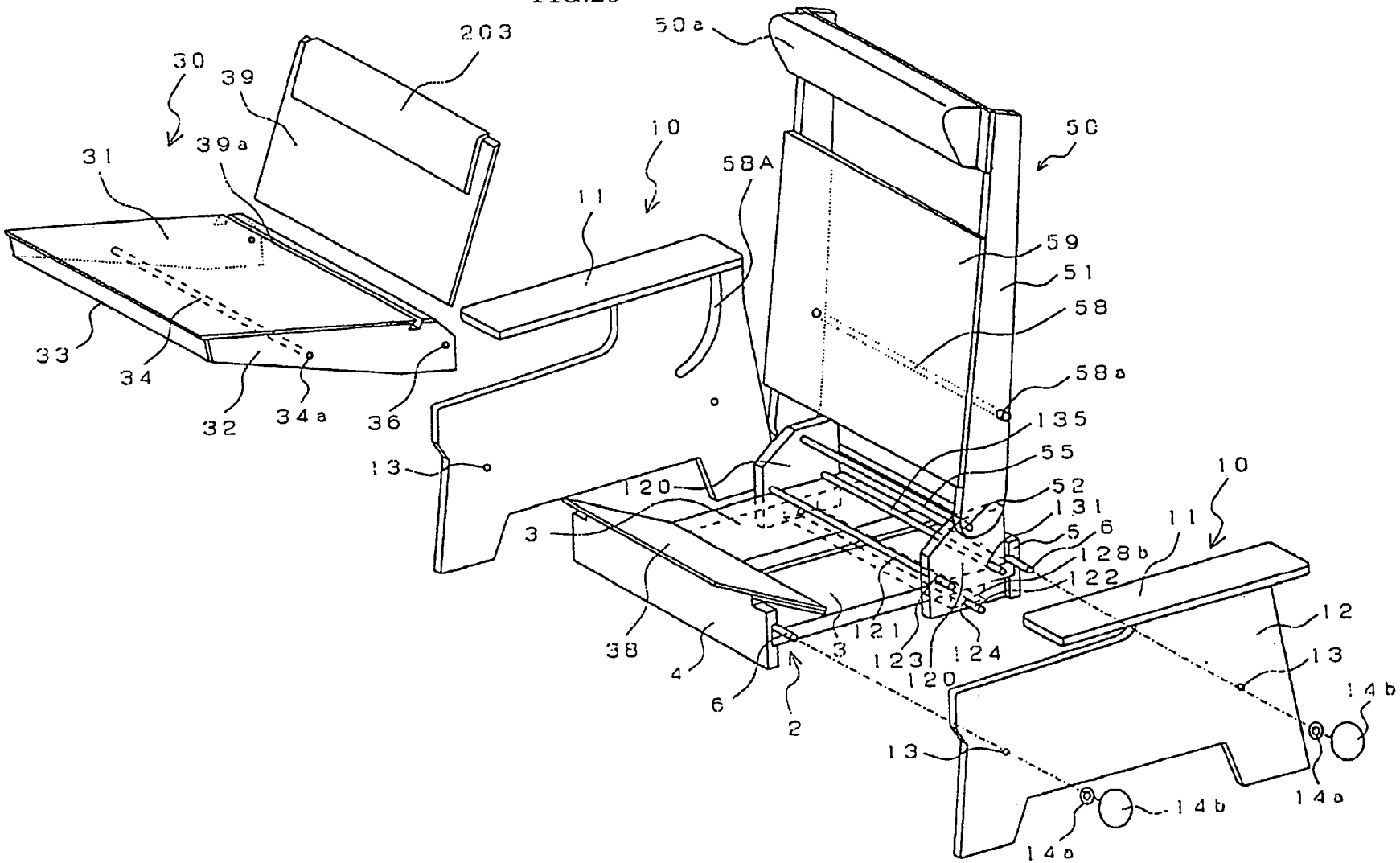
FIG. 20 is a constituting component diagram of the chair in an eighth embodiment.
Figure 21:
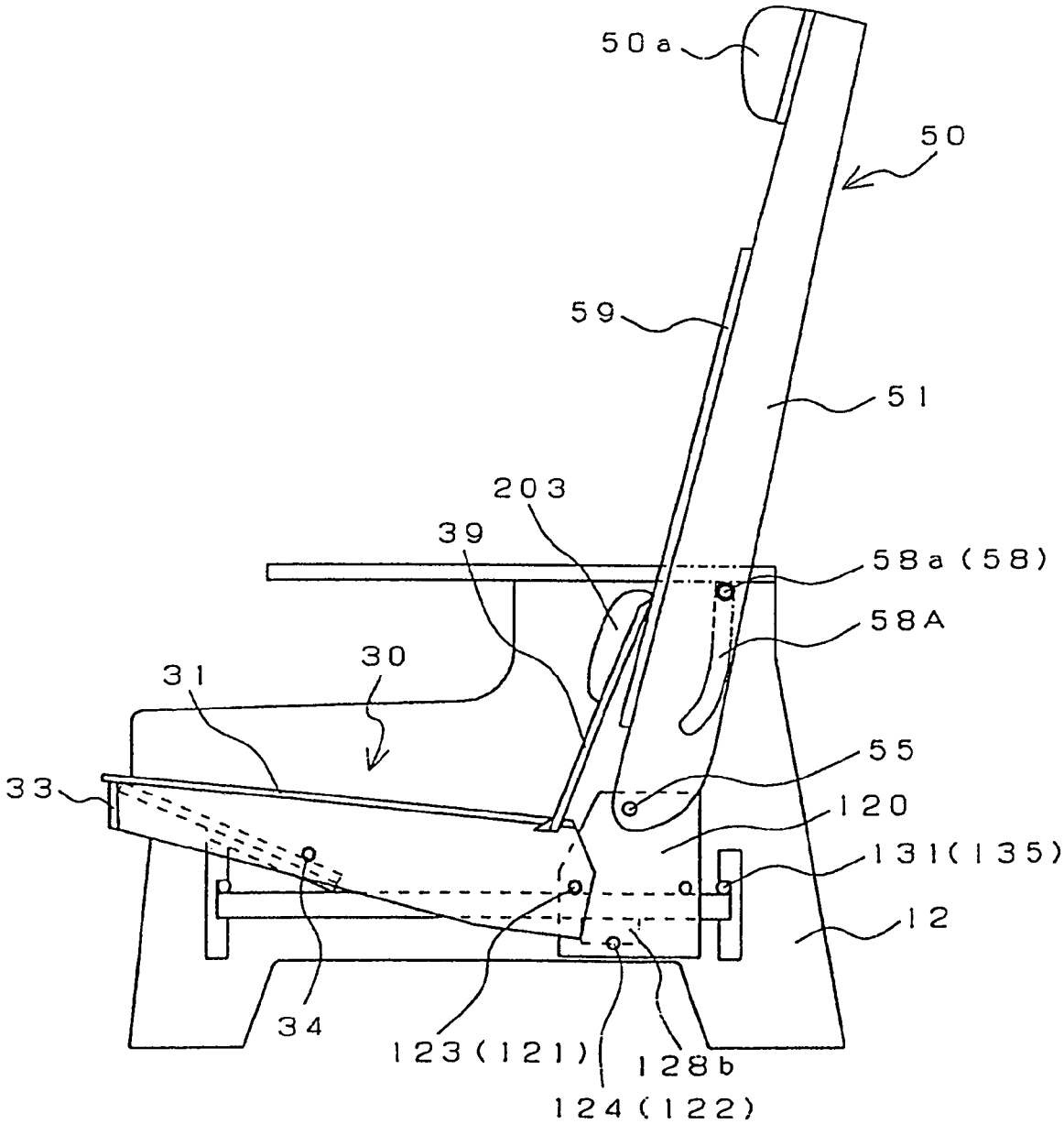
FIG. 21 is a front view of the chair in the eighth embodiment.

The reclining apparatus of the present embodiment is then improved proposal of the seventh embodiment. The components constituting the chair are shown in FIG. 20, and the front view is shown in FIG. 21. The components performing the same functions as those of the above-described embodiments are denoted with the same reference numerals and the description thereof is omitted.

The present embodiment is different from the seventh embodiment in the following respects.

The inclined connection plate 39 for filling in the gap between the seat member 30 and back member 50 is reclined on the back plate 59 of the back member 50 extending below, the upper ends of the connection plate abut on the back plate 59, and the connection plate moves forwards/backwards together with the seat member 30.

Moreover, on the surface of the connection plate 39, the mountain-shaped abutment member 203 made of the synthetic resin so as to be fitted on the person hip in the concave manner is attached in such a manner that the lower part of the transverse support member 58 can be pressed. However, the back surface does not include the curved plate 201, and is flat. It is to be noted that the abutment member 203 is attached to the position where the lower part of the transverse support member 58 described later can be pressed.

It is to be noted that the back surface of the curved plate 201 can be formed to be flat. Because the seventh embodiment is constituted such that the transverse support member 58 needs to be pressed via the connection plate 39 (abutment member 203), but this constitution is unnecessary in the present embodiment in which the transverse support member 58 is fixed.

The transverse support member 58 is fixed to the back support parts 51 of the back member 50, and a roller 58*a* is attached to the end of the member for smooth rotation.

Moreover, the guide groove 58A for guiding the roller 58*a* on the end of the transverse support member 58 is formed in the foot member 12. It is to be noted that the guide groove 58A is formed in a bow shape so as to smoothly change the back member 50 to the comfortable (inclined) state from the vertical state.

That is, in the above-described embodiments, the mechanism has been described in which the transverse support member 58 is reclined/supported via the cam holes 56 formed in the back support members 51 of the back member 50 to change the back member 50 to the inclined state from the vertical state. However, in the eighth embodiment, the transverse support member 58 is fixed to the back support parts 51, and is formed such that the member can be reclined/supported via the guide groove 58A, and accordingly the back member 50 can more smoothly be changed into the inclined state from the vertical state.

It is to be noted that even in the above-described embodiments, the mechanism of the eighth embodiment may also be used in which the transverse support member 58 is fixed and can be reclined/supported via the guide groove 58A.

It is to be noted that in the eighth embodiment, the upper brake shoe 128*a* is not disposed, and only the front press member 121 is constituted but, needless to say, the upper brake shoe 128*a* may also be disposed.

Figure 22A:
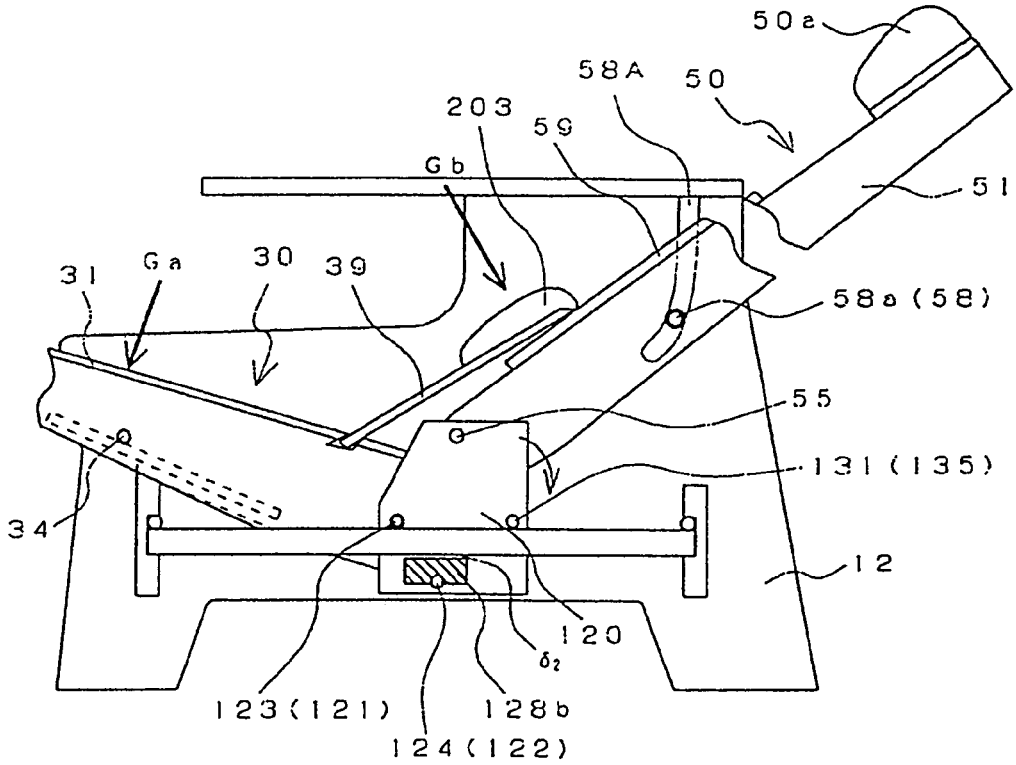
FIGS. 22(A)(B) are explanatory views of the function of the chair in the eighth embodiment.

Next, the function of the chair of the eighth embodiment will be described with reference to FIGS. 22(A)(B).

The function of the chair of the eighth embodiment is the same as that of the seventh embodiment. However, the present embodiment is different in that the transverse support member 58 is fixed to the back support parts 51, the back member 50 can be reclined/supported via the guide groove 58A, accordingly the portion to be pressed (transverse support member 58) is the same in the unlocked state, and the back member 50 can more smoothly be changed to the inclined state from the vertical state.

Then, when the person sits on the seat member 30 to press the abutment member 203 disposed below the back member 50 by the hip, the load is applied to the lower part of the transverse support member 58, and the reclining function is performed with respect to the back member 50 via the back plate 59. Moreover, by the reclining of the back member 50, the function of rotating the guide members 120 in the clockwise direction is performed to obtain the unlocked state in the axial member 55 disposed slightly deviating from the auxiliary roller 135 above the back press member 122. The transverse support member 58 is guided in the guide groove 58A, while the back member 50 can be changed to the comfortable state from the vertical state (FIG. 22(A)).

Figure 22B:
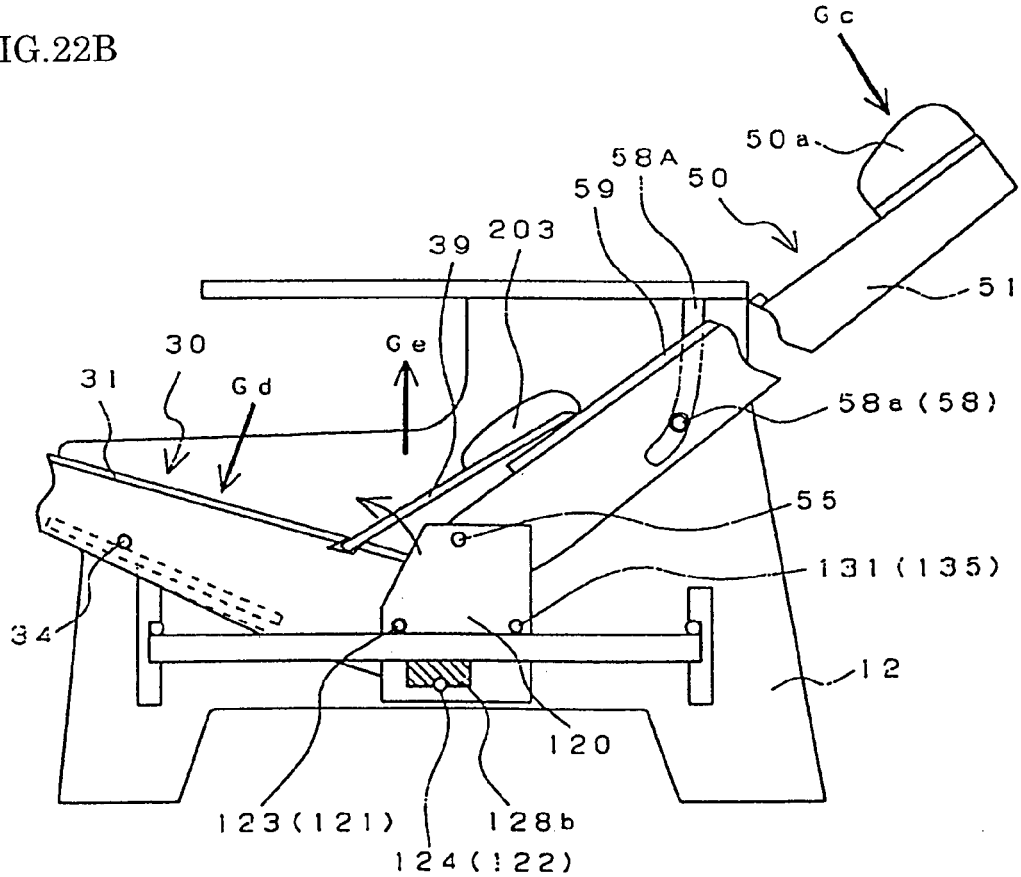

On the other hand, when the load Gc is applied above the back member 50 (the pillow member 50*a* on the top) by the head, the guide members 120 receives the rotary momentum of the counterclockwise direction to rock on the transverse support member 58 which is the base axis. The lower brake shoe 128*b* constituting the lock means and disposed on the back surface of the bottom plate 3, and the front press member 121 disposed before the lower brake shoe 128*b* on the surface of the bottom plate 3 hold the bottom plate 3 in the locked state, and the inclined state of the back member 50 is maintained (FIG. 22(B)).

As described above, in the eighth embodiment, as compared with the seventh embodiment, the transverse support member 58 fixed to the back member 50 is reclined/supported by the guide groove 58A, and the back member 50 can smoothly be changed to the inclined state from the vertical state.

It is to be noted that in the eighth embodiment, to obtain the unlocked state, the inclined connection plate 39 filling in the gap between the seat member 30 and back member 50 does not have to press the transverse support member 58 in the seventh embodiment, and is not necessarily required.

That is, without disposing the abutment member 203 on the back plate 59, the back plate 59 is extended to the seat member 30 to remove the gap. When the lower position of the back plate 59 is directly pressed, the unlocked state can be obtained, and the back member 50 can be changed to the inclined (comfortable) state from the vertical state.

Figure 23:
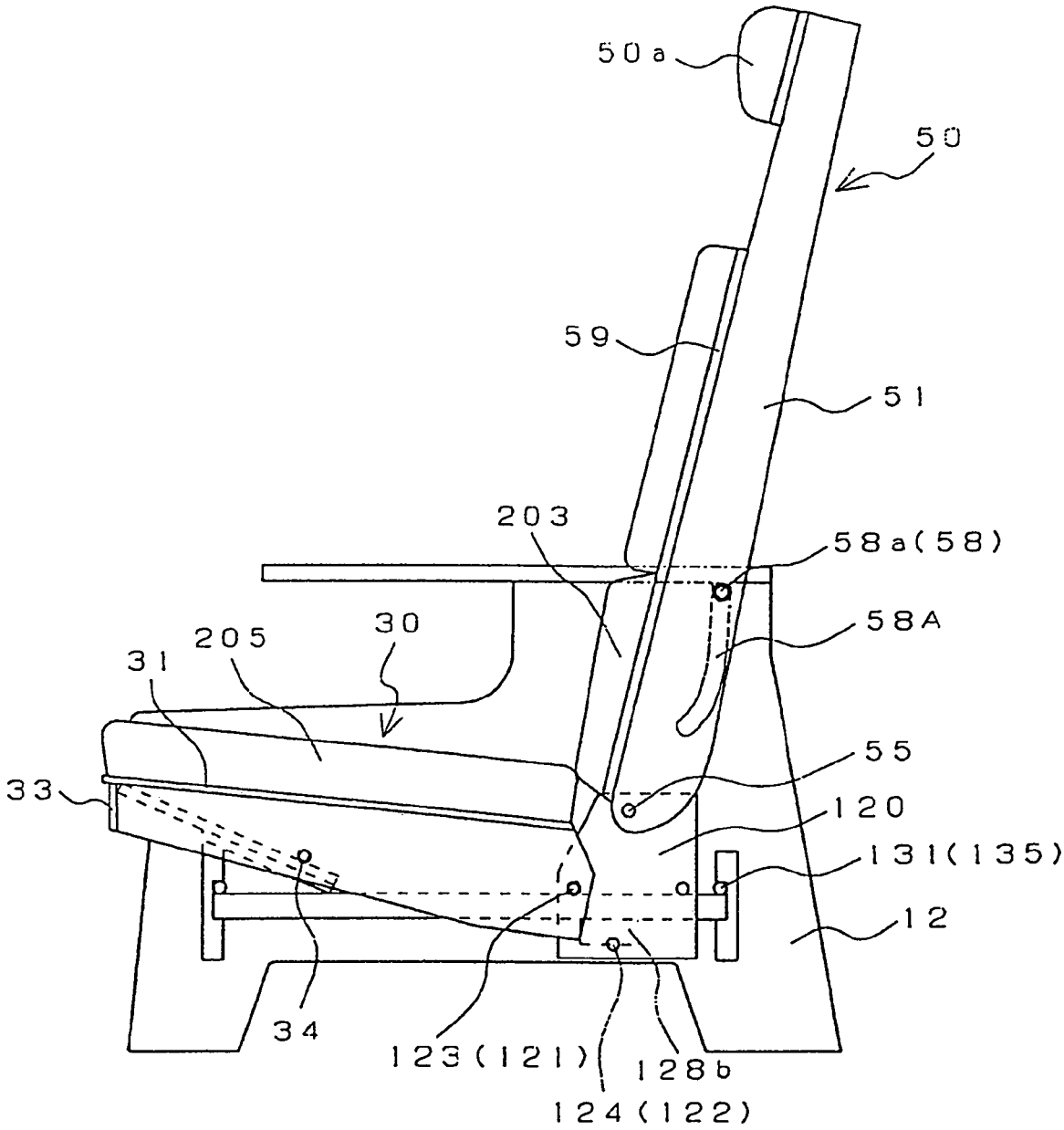
FIG. 23 is a front view of the chair showing the back member excluding a connection plate.

Moreover, even when the abutment member 203 is not disposed in the back plate 59, for example, as shown in FIG. 23, the back plate 59 is extended in the vicinity of the seat member 30. The abutment member 203 is disposed on the back plate 59 in such a manner that the lower part of the transverse support member 58 can be pressed. Moreover a cushion member 205 is disposed on the seat member 30 such that the member can abut on the abutment member 203. Accordingly, the gap between the seat member 30 and back member 50 can be eliminated. When the abutment member 203 is pressed, the unlocked state can be obtained, and the position to be pressed can be clarified.

It is to be noted that the components having the same component names as those for use in the above-described embodiments, such as the guide members 20 and guide members 120, and the auxiliary roller 80 and auxiliary roller 135, are the components substantially performing the same functions, the materials of the respective components are appropriately selected.

As described above, in the reclining apparatus of the present invention, by the mechanism for moving the guide members 20, 120 forwards/backwards via the rollers slidable on the surface or the whole back surface of the bottom plate 3, the guide members 20, 120 include the rectilinear properties and can smoothly move forwards/backwards. With the forward/backward movement of the guide members 20, 120, the seat member 30 moves, and the back member 50 is inclined.

Moreover, in the reclining apparatus of the present invention, when the person's load position is varied, the guide members 20, 120 can rock, and the looked and unlocked state can be obtained depending on whether or not the bottom plate 3 is held by the lock means (constituted, for example, of the brake shoe or the roller) in the simple constitution.

Therefore, it is obvious that the load position for achieving the locked state and unlocked state differs with the positions of the back member, seat member, and roller constituting the reclining apparatus, and the structure of the lock means. The reclining apparatus of the present invention is not limited to the structures of the respective embodiments. Moreover, the mechanisms in the respective embodiments can appropriately be combined to constitute the present invention, and the present invention is not limited to the chair described above, and can be applied to any other appliance.

INDUSTRIAL APPLICABILITY

As described above, a reclining apparatus according to the present invention can be used in a chair, and the like.

The invention claimed is:

1. A reclining apparatus comprising:

guide members disposed on opposite sides of a bottom plate so as to be movable forward and backward;

a back member, which supports a person's back, being rotatably connected to the guide members and being supported with respect to a foot member so as to be reclinable;

front and back rollers being at least one of slidable and rotatable along the bottom plate for moving the guide members forward and backward; and a brake shoe, capable of contacting the bottom plate, and a seat member are attached to the guide members;

wherein the brake shoe, when in a locked state, retains the back roller against the bottom plate and, when in an unlocked state, permits movement of the back roller along the bottom plate by rocking of the guide members.

2. The reclining apparatus according to claim 1, further comprising:

a connection plate inserted in a rear end of the seat member so that the connection plate can abut against the guide members; and an auxiliary roller attached to the guide members on a rear side of an axial member so that the auxiliary roller can roll along the bottom plate, when the guide members rotate in a clockwise direction.

3. The reclining apparatus according to claim 1, wherein the reclining apparatus further comprises a roller plate having a convex curved shape.

4. The reclining apparatus according to claim 1, wherein the bottom plate has a front-rising linearly inclined shape.

5. The reclining apparatus according claim 1, further comprising an armrest part formed so as to be movable forward and backward with respect to the foot member so that at least one of a side plate and the seat member can be moved forward and backward via a connection member attached to the armrest part.

6. A reclining apparatus comprising:

guide members disposed on opposite sides of a bottom plate so as to be movable forward and backward;

a back member, which supports a person's back, and is rotatably connected to the guide members via an axial member which is supported so as to be reclinable with respect to a foot member;

at least one of an upper brake shoe, which can contact a front surface of the bottom plate via a front press member attached to the guide members, and a lower brake shoe, which can contact a back surface of the bottom plate via a back press member attached to the guide members; and an auxiliary roller attached to the guide members so as to be at least one of slidable and rotatable along the front surface of the bottom plate in a position on the rear side of the axial member;

wherein the brake shoe retains the roller in a locked state, and permits movement of the roller, in an unlocked state by rocking of the guide members.

* * * * *